US010403982B2

(12) United States Patent
Tatomir

(10) Patent No.: US 10,403,982 B2
(45) Date of Patent: Sep. 3, 2019

(54) DUAL-MODE ANTENNA ARRAY SYSTEM

(71) Applicant: The Boeing Company, Chicago, IL (US)

(72) Inventor: Paul J. Tatomir, Palm Desert, CA (US)

(73) Assignee: The Boeing Company, Chicago, IL (US)

( * ) Notice: Subject to any disclaimer, the term of this patent is extended or adjusted under 35 U.S.C. 154(b) by 63 days.

(21) Appl. No.: 15/717,894

(22) Filed: Sep. 27, 2017

(65) Prior Publication Data

US 2019/0097325 A1 Mar. 28, 2019

(51) Int. Cl.

| | |
|---|---|
| ***H01Q 21/00*** | (2006.01) |
| ***H01Q 21/22*** | (2006.01) |
| ***H01Q 3/34*** | (2006.01) |
| *H01Q 13/02* | (2006.01) |

(52) U.S. Cl.

CPC ..... *H01Q 21/005* (2013.01); *H01Q 3/34* (2013.01); *H01Q 21/22* (2013.01); *H01Q 13/025* (2013.01); *H01Q 13/0233* (2013.01)

(58) Field of Classification Search

CPC ..... H01Q 21/005; H01Q 3/34; H01Q 21/22
See application file for complete search history.

(56) References Cited

U.S. PATENT DOCUMENTS 3,518,576 A * 6/1970 Algeo ..... H01P 5/16 333/114
3,646,559 A * 2/1972 Wiley ..... H01Q 3/22 342/371

OTHER PUBLICATIONS

Solbach, K. , "Below-Resonant-Length Slot Radiators for Traveling-Wave-Array Antennas,", Antennas and Propagation Magazine, IEEE, vol. 38, No. 1, pp. 7-14, Feb. 1996.

* cited by examiner

*Primary Examiner* — Graham P Smith
*Assistant Examiner* — Jae K Kim
(74) *Attorney, Agent, or Firm* — Toler Law Group, PC

(57) ABSTRACT

Disclosed is a dual-mode antenna array system ("DAAS") for directing and steering an antenna beam that includes an approximately square feed ("ASF") waveguide, a plurality of first-mode directional couplers ("FMDCs"), a plurality of second-mode directional couplers ("SMDCs"), a plurality of first-mode radiating elements ("FMREs"), and a plurality of second-mode radiating elements ("SMREs"). The ASF waveguide includes a first ASF waveguide wall, a second ASF waveguide wall, an ASF waveguide length, a first-feed waveguide input at a first-end of the ASF feed waveguide, and a second-feed waveguide input at a second-end of the ASF feed waveguide. The plurality of FMDCs are on the first ASF waveguide wall and the plurality of SMDCs are on the second ASF waveguide wall. The plurality of FMREs are in signal communication with the plurality of FMDCs and the plurality of SMREs are in signal communication with the plurality of SMDCs.

25 Claims, 24 Drawing Sheets

DUAL-MODE ANTENNA ARRAY SYSTEM

BACKGROUND

1. Field

This present invention relates generally to microwave devices, and more particularly, to antenna arrays.

2. Related Art

In today's modern society, satellite communication systems have become common place. There are now numerous types of communication satellites in various orbits around the Earth transmitting and receiving huge amounts of information. Telecommunication satellites are utilized for microwave radio relay and mobile applications, such as, for example, communications to ships, vehicles, airplanes, personal mobile terminals, Internet data communication, television, and radio broadcasting. As a further example, with regard to Internet data communications, there is also a growing demand for in-flight Wi-Fi® Internet connectivity on transcontinental and domestic flights. Unfortunately, because of these applications, there is an ever increasing need for the utilization of more communication satellites and the increase of bandwidth capacity of each of these communication satellites.

A problem to solving this need is that individual communication satellite systems are very expensive to fabricate, place in Earth orbit, operate, and maintain. Another problem to solving this need is that there are limiting design factors to increasing the bandwidth capacity in a communication satellite. One of these limiting design factors is the relatively compact physical size and weight of a communication satellite. Communication satellite designs are limited by the size and weight parameters that are capable of being loaded into and delivered into orbit by a modern satellite delivery system (i.e., the rocket system). The size and weight limitations of a communication satellite limit the type of electrical, electronic, power generation, and mechanical subsystems that may be included in the communication satellite. As a result, the limit of these types of subsystems are also limiting factors to increasing the bandwidth capacity of a satellite communication.

It is appreciated by those of ordinary skill in the art, that in general, the limiting factors to increase the bandwidth capacity of a communication satellite is determined by the transponders, antenna system(s), and processing system(s) of the communication satellite.

With regard to the antenna system (or systems), most communication satellite antenna systems include some type of antenna array system. In the past reflector antennas (such as parabolic dishes) were utilized with varying numbers of feed array elements (such as feed horns). Unfortunately, these reflector antenna systems typically scanned their antenna beams utilizing mechanical means instead of electronic means. These mechanical means generally include relatively large, bulky, and heavy mechanisms (i.e., antenna gimbals).

More recently, there have been satellites that have been designed utilizing non-reflector phased array antenna systems. These phased array antenna systems are capable of increasing the bandwidth capacity of the antenna system as compared to previous reflector type of antenna systems. Additionally, these phased array antenna systems are generally capable of directing and steering antenna beams without mechanically moving the phase array antenna system. Generally, dynamic phased array antenna systems utilize variable phase shifters to move the antenna beam without physically moving the phased array antenna system. Fixed phased array antenna systems, on the other hand, utilize fixed phased shifters to produce an antenna beam that is stationary with respect to the face of the phased array antenna system. A such, fixed phased array antenna systems require the movement of the entire antenna system (with for example, an antenna gimbal) to directing and steering the antenna beam.

Unfortunately, while dynamic phased array antenna systems are more desirable then fixed phased array antenna systems they are also more complex and expensive since they require specialized active components (e.g., power amplifiers and active phase shifters) and control systems. As such, there is a need for a new type of phased array antenna system capable of electronically scanning an antenna beam that is robust, efficient, compact, and solves the previously described problems.

SUMMARY

Disclosed is a dual-mode antenna array system ("DAAS") for directing and steering an antenna beam. The DAAS includes an approximately square feed ("ASF") waveguide, a plurality of first-mode directional couplers ("FMDCs"), a plurality of second-mode directional couplers ("SMDCs"), a plurality of first-mode radiating elements ("FMREs"), and a plurality of second-mode radiating elements ("SMREs"). The ASF waveguide includes a first ASF waveguide wall, a second ASF waveguide wall, an ASF waveguide length, a first-feed waveguide input at a first-end of the ASF feed waveguide, and a second-feed waveguide input at a second-end of the ASF feed waveguide. The plurality of FMDCs are on the first ASF waveguide wall and the plurality of SMDCs are on the second ASF waveguide wall. The plurality of FMREs are in signal communication with the plurality of FMDCs and the plurality of SMREs are in signal communication with the plurality of SMDCs. The ASF waveguide is configured to receive a first-mode input signal and a second-mode input signal at the first-feed waveguide input and a first-mode input signal and a second-mode input signal at the second-feed waveguide input.

In an example of operation, the DAAS performs a method that includes first receiving the first-mode input signal and a second-mode input signal at the first-feed waveguide input. The method further includes coupling the first-mode input signal to a first FMDC and a second FMDC, of the plurality of FMDCs, where the first FMDC produces a first first-mode forward coupled ("$1^{st}$ FMFC") signal of the first FMDC and the second FMDC produces a second first-mode forward coupled ("$2^{nd}$ FMFC") signal of the second FMDC and coupling the second-mode input signal to a first SMDC and a second SMDC, of the plurality of SMDCs, wherein the first SMDC produces a first second-mode forward coupled ("$1^{st}$ SMFC") signal of the first SMDC and the second SMDC produces a second second-mode forward coupled ("$2^{nd}$ SMFC") signal of the second SMDC. The method then includes radiating a first first-mode forward polarized ("FMFP") signal from a first FMRE, of the plurality of FMREs, in response to the first FMRE receiving the first FMFC signal of the first FMDC, radiating a second FMFP signal from a second FMRE, of the plurality of FMREs, in response to the second FMRE receiving the $2^{nd}$ FMFC signal of the second FMDC, radiating a first second-mode forward polarized ("SMFP") signal from a first SMRE, of the plurality of SMREs, in response to the first SMRE receiving the $1^{st}$ FMFC signal of the first FMDC, and radiating a second SMFP signal from a second SMRE, of the plurality of SMREs, in response to the second SMRE receiving the $2^{nd}$ FMFC signal of the second FMDC. In this example, the first FMFP signal is co-polarized with the second FMFP signal and the first SMFP signal is co-polarized with the second SMFP signal.

Other devices, apparatus, systems, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
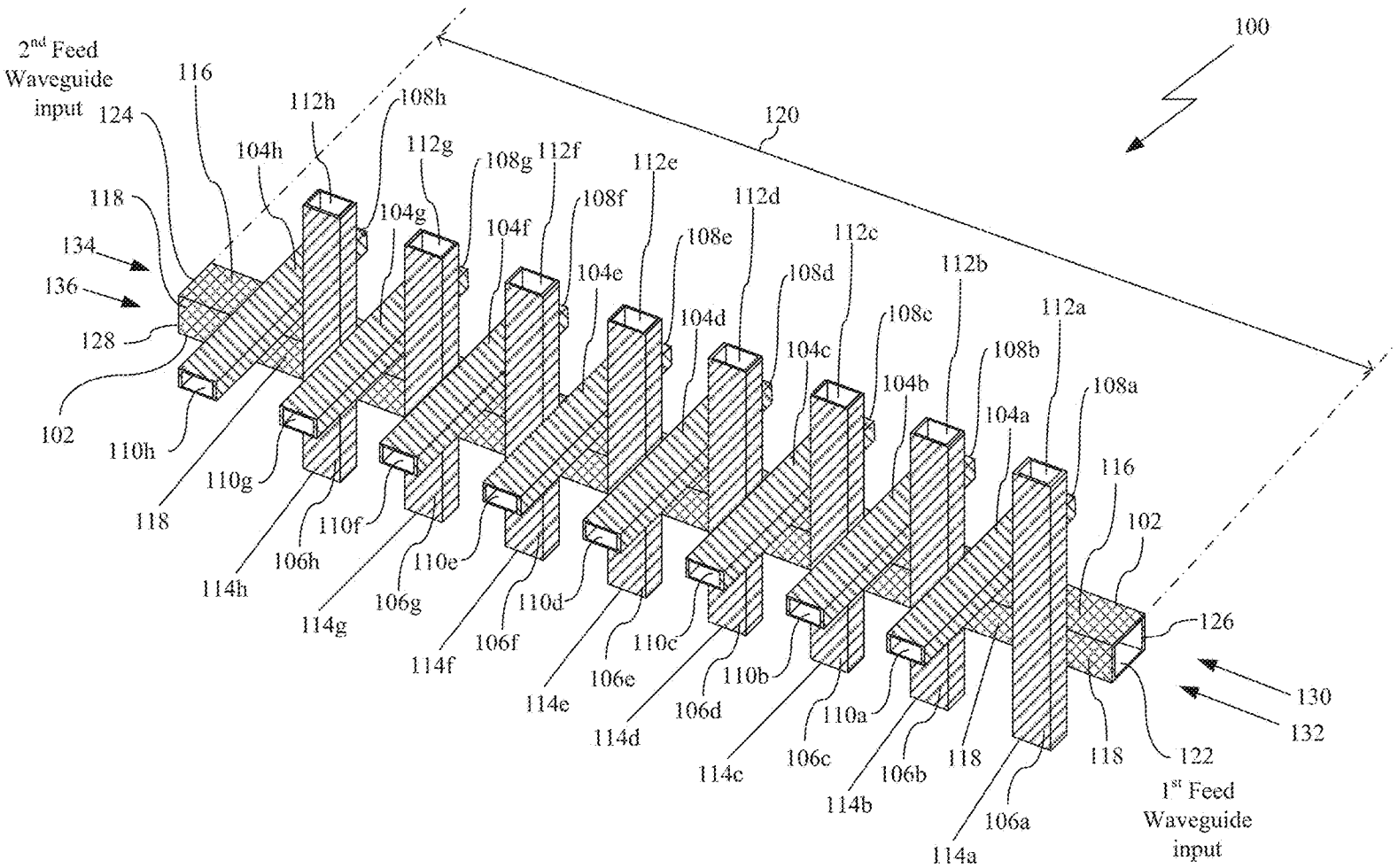
FIG. 1A is a perspective view of a dual-mode antenna array system ("DAAS") in accordance with the present disclosure.

Disclosed is a dual-mode antenna array system ("DAAS") for directing and steering an antenna beam. The DAAS includes an approximately square feed ("ASF") waveguide, a plurality of first-mode directional couplers ("FMDCs"), a plurality of second-mode directional couplers ("SMDCs"), a plurality of first-mode radiating elements ("FMREs"), and a plurality of second-mode radiating elements ("SMREs"). The ASF waveguide includes a first ASF waveguide wall, a second ASF waveguide wall, an ASF waveguide length, a first-feed waveguide input at a first-end of the ASF feed waveguide, and a second-feed waveguide input at a second-end of the ASF feed waveguide. The plurality of FMDCs are on the first ASF waveguide wall and the plurality of SMDCs are on the second ASF waveguide wall. The plurality of FMREs are in signal communication with the plurality of FMDCs and the plurality of SMREs are in signal communication with the plurality of SMDCs. The ASF waveguide is configured to receive a first-mode input signal and a second-mode input signal at the first-feed waveguide input and a first-mode input signal and a second-mode input signal at the second-feed waveguide input.

In an example of operation, the DAAS performs a method that includes first receiving the first-mode input signal and a second-mode input signal at the first-feed waveguide input. The method further includes coupling the first-mode input signal to a first FMDC and a second FMDC, of the plurality of FMDCs, where the first FMDC produces a first first-mode forward coupled ("1$^{st}$ FMFC") signal of the first FMDC and the second FMDC produces a second first-mode forward coupled ("2$^{nd}$ FMFC") signal of the second FMDC and coupling the second-mode input signal to a first SMDC and a second SMDC, of the plurality of SMDCs, wherein the first SMDC produces a first second-mode forward coupled ("1$^{st}$ SMFC") signal of the first SMDC and the second SMDC produces a second second-mode forward coupled ("2$^{nd}$ SMFC") signal of the second SMDC. The method then includes radiating a first first-mode forward polarized ("FMFP") signal from a first FMRE, of the plurality of FMREs, in response to the first FMRE receiving the first FMFC signal of the first FMDC, radiating a second FMFP signal from a second FMRE, of the plurality of FMREs, in response to the second FMRE receiving the 2$^{nd}$ FMFC signal of the second FMDC, radiating a first second-mode forward polarized ("SMFP") signal from a first SMRE, of the plurality of SMREs, in response to the first SMRE receiving the 1$^{st}$ FMFC signal of the first FMDC, and radiating a second SMFP signal from a second SMRE, of the plurality of SMREs, in response to the second SMRE receiving the 2$^{nd}$ FMFC signal of the second FMDC. In this example, the first FMFP signal is co-polarized with the second FMFP signal and the first SMFP signal is co-polarized with the second SMFP signal.

FIGS. 1A, 1B, 1C, 1D, and 1E, various views of an example of an implementation of an AAS 100 are shown in accordance with the present disclosure. Specifically, in FIG. 1A, a perspective view of a DAAS 100 is shown in accordance with the present disclosure. The DAAS 100 includes an ASF waveguide 102, a plurality of first-mode directional couplers 104*a*, 104*b*, 104*c*, 104*d*, 104*e*, 104*f*, 104*g*, and 104*h*, and a plurality of second-mode directional couplers 106*a*, 106*b*, 106*c*, 106*d*, 106*e*, 106*f*, 106*g*, and 106*h*. In this example, the plurality of first-mode directional couplers 104*a*, 104*b*, 104*c*, 104*d*, 104*e*, 104*f*, 104*g*, and 104*h* may include a plurality of first ports 108*a*, 108*b*, 108*c*, 108*d*, 108*e*, 108*f*, 108*g*, and 108*h* and a plurality of second ports 110*a*, 110*b*, 110*c*, 110*d*, 110*e*, 110*f*, 110*g*, and 110*h*. The plurality of first ports 108*a*, 108*b*, 108*c*, 108*d*, 108*e*, 108*f*, 108*g*, and 108*h* and the plurality of second ports 110*a*, 110*b*, 110*c*, 110*d*, 110*e*, 110*f*, 110*g*, and 110*h* of the first-mode directional couplers 104*a*, 104*b*, 104*c*, 104*d*, 104*e*, 104*f*, 104*g*, and 104*h* may be in signal communication with a plurality of first-mode radiating elements (not shown). Similarly, the plurality of second-mode directional couplers 106*a*, 106*b*, 106*c*, 106*d*, 106*e*, 106*f*, 106*g*, and 106*h* may include a plurality of first ports 112*a*, 112*b*, 112*c*, 112*d*, 112*e*, 112*f*, 112*g*, and 112*h* and a plurality of second ports 114*a*, 114*b*, 114*c*, 114*d*, 114*e*, 114*f*, 114*g*, and 114*h*. The plurality of first ports 112*a*, 112*b*, 112*c*, 112*d*, 112*e*, 112*f*, 112*g*, and 112*h* and the plurality of second ports 114*a*, 114*b*, 114*c*, 114*d*, 114*e*, 114*f*, 114*g*, and 114*h* of the plurality of second-mode directional couplers 106*a*, 106*b*, 106*c*, 106*d*, 106*e*, 106*f*, 106*g*, and 106*h* may be in signal communication with a plurality of second-mode radiating elements (not shown). As shown in FIG. 1, each of the directional couplers of the plurality of first-mode directional couplers 104*a*, 104*b*, 104*c*, 104*d*, 104*e*, 104*f*, 104*g*, and 104*h* and plurality of second-mode directional couplers may be cross-couplers 106*a*, 106*b*, 106*c*, 106*d*, 106*e*, 106*f*, 106*g*, and 106*h*.

The ASF waveguide 102 includes a first ASF waveguide wall 116, a second ASF waveguide wall 118, an ASF waveguide length 120, a first-feed waveguide input 122, and a second-feed waveguide input 124. The first-feed waveguide input 122 is at a first-end 126 of the ASF feed waveguide 102 and the second-feed waveguide input 124 is at a second-end 128 of the ASF waveguide 102. The ASF waveguide 102 is configured to receive a first-mode input signal 130 and a second-mode input signal 132 at the first-feed waveguide input 122. Similarly, the ASF waveguide 102 is also configured to receive a first-mode input signal 134 and a second-mode input signal 136 at the second-feed waveguide input 124.

In this example, the second-mode input signal 132 at the first-feed waveguide input 122 is orthogonal (or approximately orthogonal) to the first-mode input signal 130 at the first-feed waveguide input 122. As an example, the first-mode input signal 132 may be a $TE_{10}$ mode signal while the second-mode input signal 134 is a $TE_{01}$ mode signal. Likewise, the second-mode input signal 136 at the second-feed waveguide input 124 is orthogonal (or approximately orthogonal) to the first-mode input signal 134 at the second-feed waveguide input 124. Moreover, the first-mode input signal 134 at the second-feed waveguide input 124 is a signal that travels in the opposite direction along the ASF feed waveguide 102 as compared to the first-mode input signal 130 at the first-feed waveguide input 122 (i.e., the first-mode input signal 134 is a 180 degrees out of phase from the first-mode input signal 130). Similarly, the second-mode input signal 136 at the second-feed waveguide input 124 is a signal that travels in the opposite direction along the ASF feed waveguide 102 as compared to the second-mode input signal 132 at the first-feed waveguide input 122 (i.e., the second-mode input signal 136 is a 180 degrees out of phase from the second-mode input signal 132). It is appreciated by those of ordinary skill in the art that as utilized in this disclosure, the term "mode" refers to the different modes of electromagnetic excitation in the ASF waveguide 102, such as, for example, the TE and TM modes of operation within a waveguide.

Furthermore, in this example, the ASF waveguide 102 is an approximately square waveguide instead of a conventional rectangular waveguide having a broad wall and a narrow wall. As such, the ASF waveguide 102 is a rectangular waveguide that has an approximately equal broad wall (for example, the first ASF waveguide wall 116) and narrow wall (for example, the second ASF waveguide wall 118) allowing simultaneous transmission of orthogonal modes such as, for example, the $TE_{10}$ and $TE_{01}$ modes. The orthogonal modes may be produced with an orthomode transducer ("OMT") (also generally known as a polarization duplexer). In this example, a first OMT (not shown) may be in signal communication with the first-feed waveguide input 122 and a second OMT (not shown) may be in signal communication with the second-feed waveguide input 124, where the first OMT combines the two orthogonal signals (i.e., first-mode input signal 130 and second-mode input signal 132) and injects the combined two orthogonal signals into the first-feed waveguide input 122. The second OMT then receives remaining portions (if any) of the combined two orthogonal signals at the second-feed waveguide input 124 and separates them into two orthogonal output signals (not shown). Similarly, the second OMT may also receive and combine two orthogonal signals traveling in the opposite direction along the ASF waveguide 102 (i.e., first-mode input signal 134 and second-mode input signal 136) and then inject the combined two orthogonal signals into the second-feed waveguide input 124. The first OMT then receives remaining portions (if any) of the combined two orthogonal signals at the first-feed waveguide input 122 and separates them into another two orthogonal output signals (not shown).

Figure 1B:
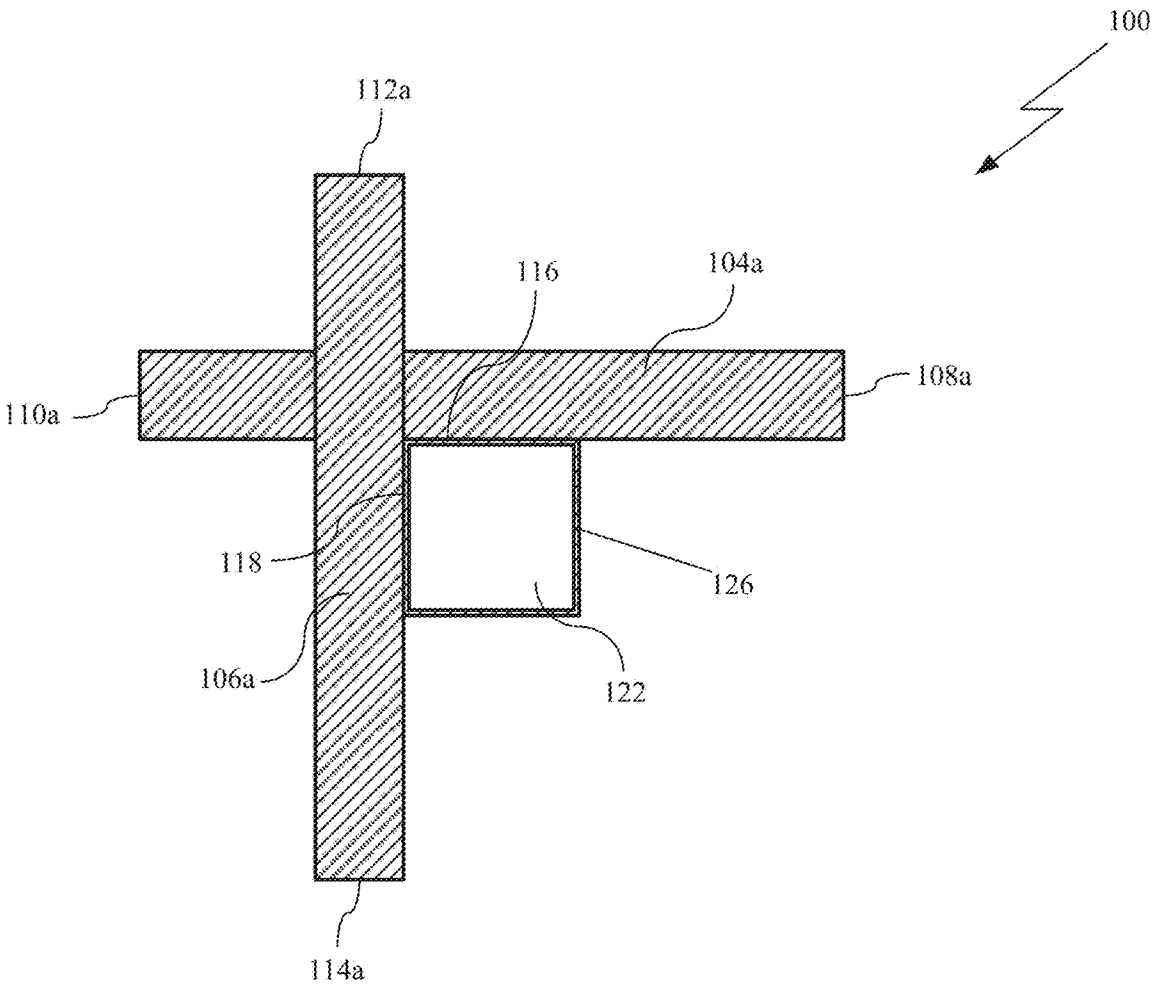
FIG. 1B is a front view of the DAAS in accordance with the present disclosure.
Figure 1C:
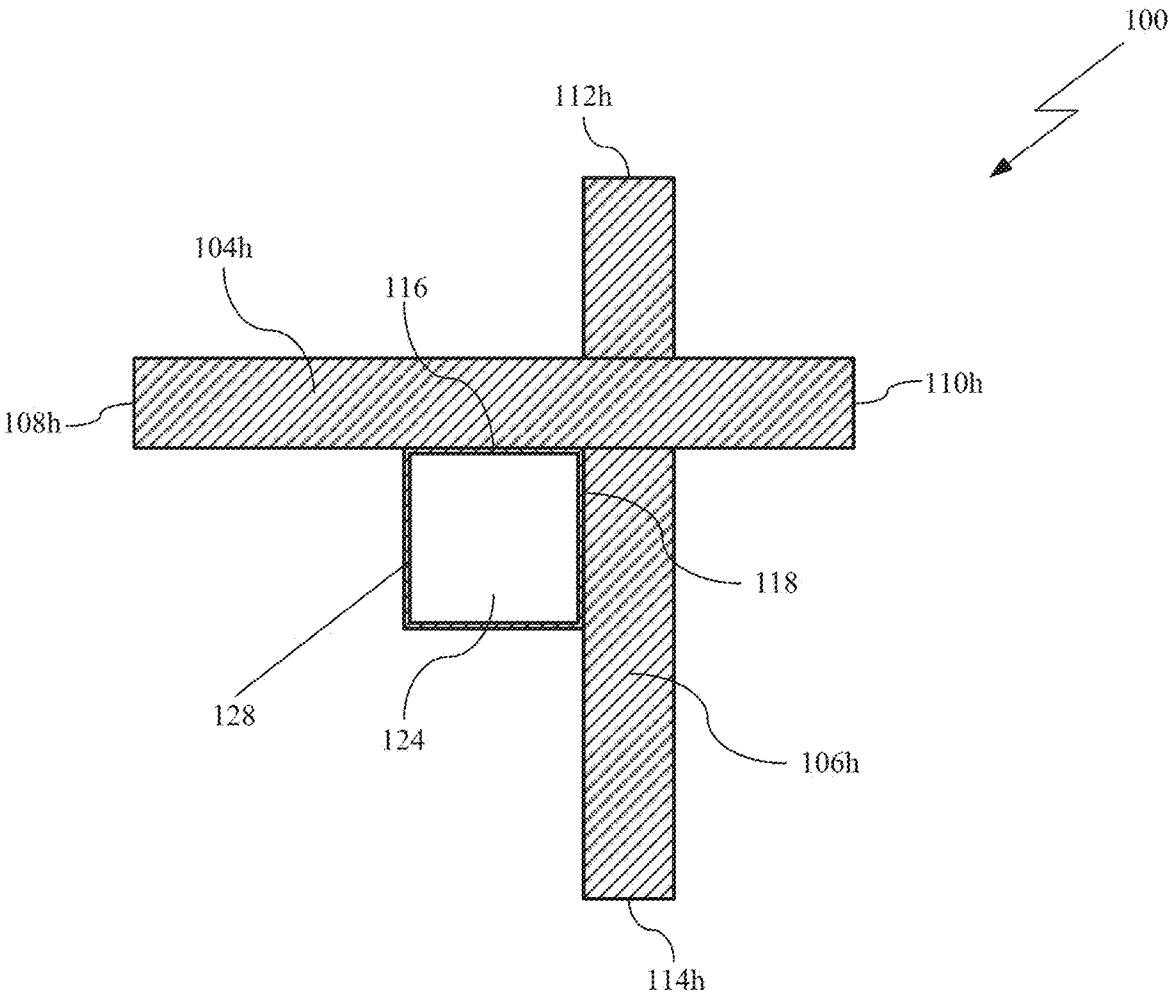
FIG. 1C is a rear view of the DAAS in accordance with the present disclosure.
Figure 1D:
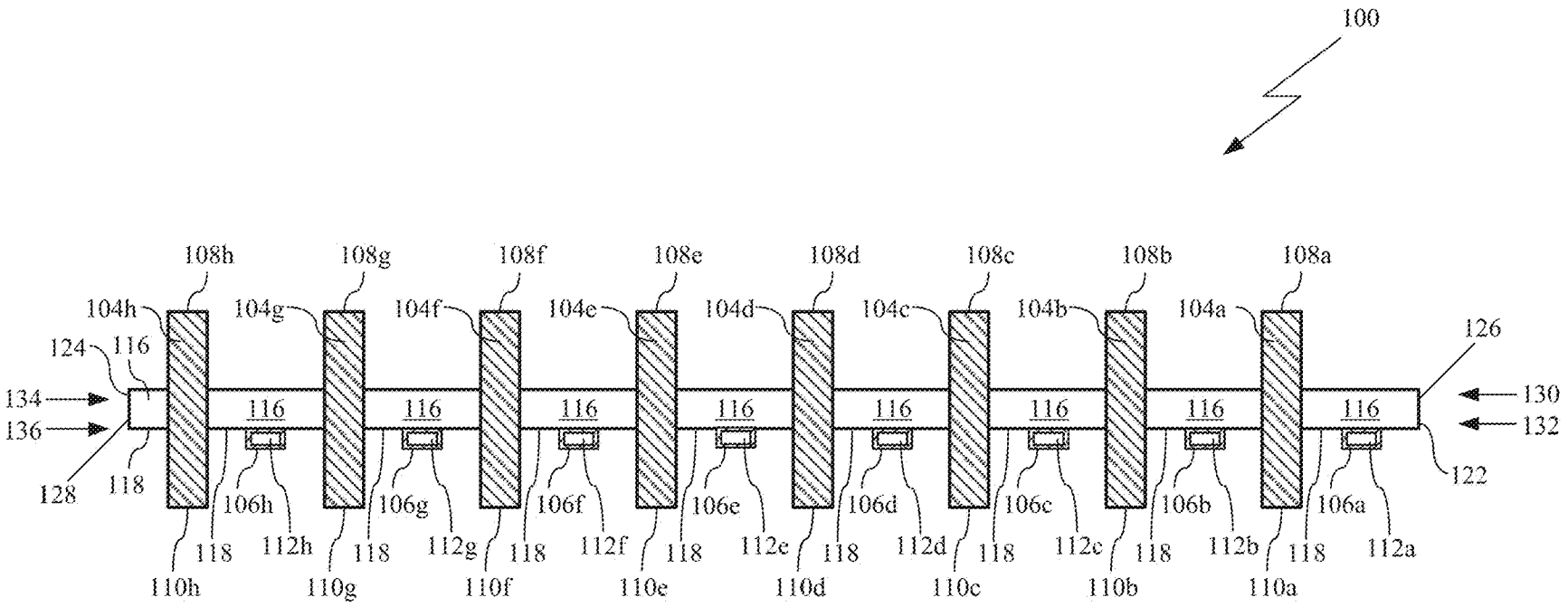
FIG. 1D is a top view of the DAAS in accordance with the present disclosure.
Figure 1E:
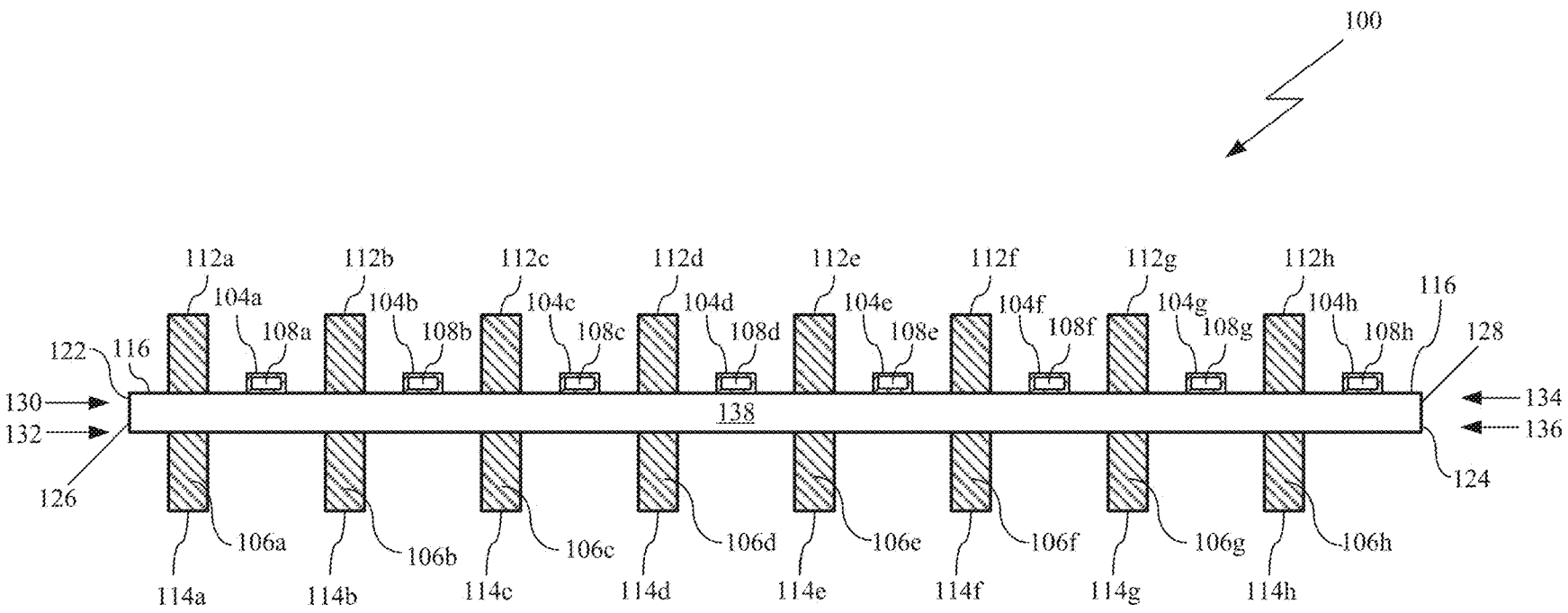
FIG. 1E is a side view of the DAAS in accordance with the present disclosure.

In FIG. 1B, a front view of the DAAS 100 is shown in accordance with the present disclosure. In FIG. 1C, a rear view of the DAAS 100 is shown in accordance with the present disclosure. In FIG. 1D, a top view of the DAAS 100 is shown in accordance with the present disclosure. In FIG. 1E, a side view of the DAAS 100 is shown in accordance with the present disclosure. It is noted that in FIG. 1E, the second ASF waveguide wall 118 is not visible in the side view since it is blocked by a third ASF waveguide wall 138.

Figure 2:
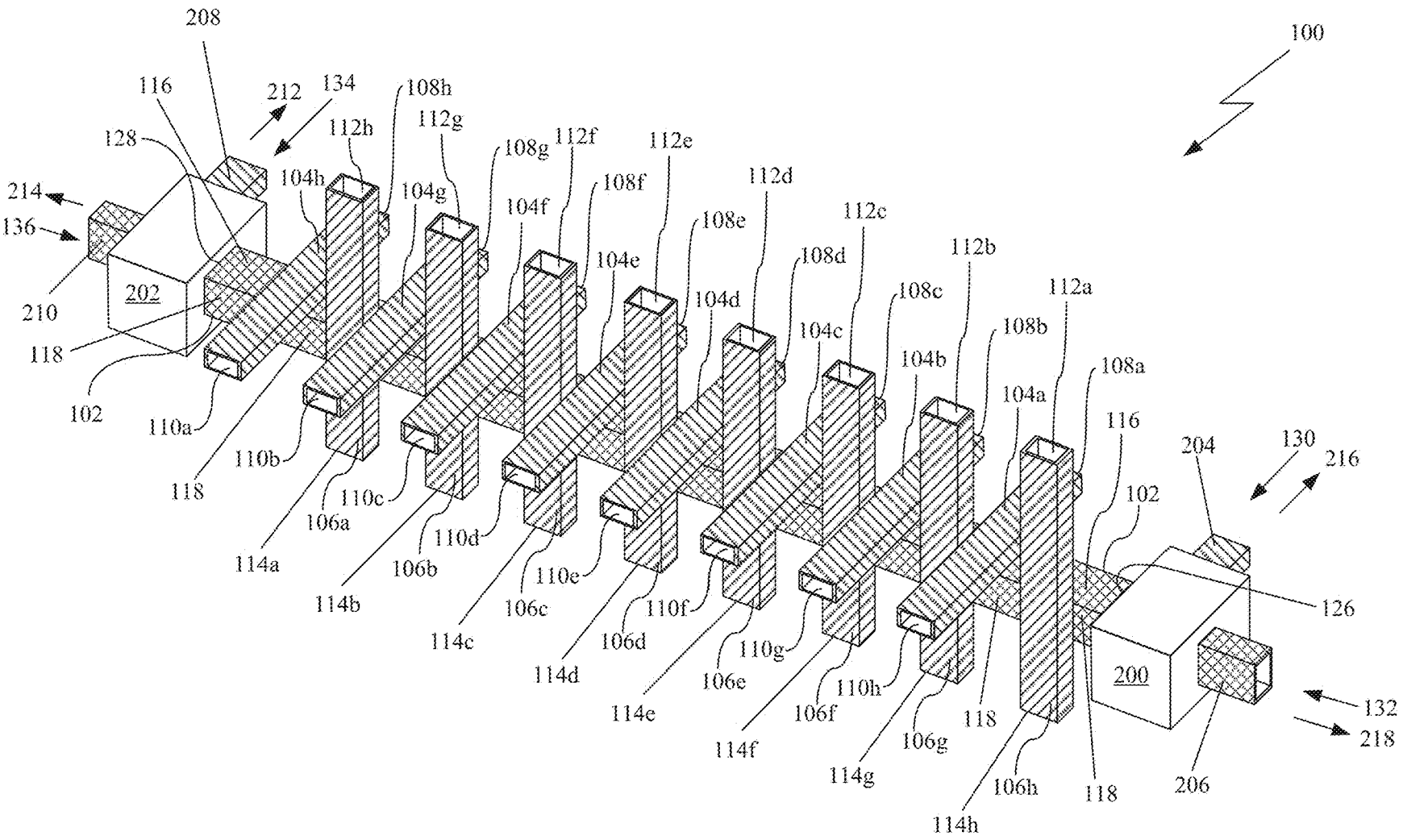
FIG. 2 is a perspective view of the DAAS with a first OMT and a second OMT in signal communication with an ASF waveguide, shown in FIGS. 1A through 1E, in accordance with the present disclosure.

Turning to FIG. 2, a perspective view of the DAAS 100 is shown with a first OMT 200 and a second OMT 202 in signal communication with the ASF waveguide 102, where the first OMT 200 is in signal communication with the ASF waveguide 102 at the first-end 126 of the ASF waveguide 126 and the second OMT 202 is in signal communication with the ASF waveguide 102 at the second-end 128 of the ASF waveguide 126. The first OMT 200 includes a first-mode port 204 and a second-mode port 206. Similarly, the second OMT 202 also includes a first-mode port 208 and a second-mode input port 210.

In this example, the first OMT 200 is configured to receive the first-mode input signal 130 at the first-mode port 204 and the second-mode input signal 132 at the second-mode port 206. Similarly, the second OMT 202 is configured to receive the first-mode input signal 134 at the first-mode port 208 and the second-mode input signal 136 at the second-mode port 210. As an example of operation, any first-mode remaining portion of the signal ("$1^{st}$ mode RS") 212 of the remaining energy (if any) of the first-mode input signal 130 is emitted from the first-mode port 208 of the second OMT 202 and any second-mode remaining portion of the signal ("$2^{nd}$ mode RS") 214 of the remaining energy (if any) of the second-mode input signal 132 is emitted from the second-mode port 210 of the second OMT 202. Similarly, with regards to the second OMT 202, any first-mode remaining portion of the reverse signal ("$1^{st}$ mode RRS") 216 of the remaining energy (if any) of the first-mode input signal 134 into the second OMT 202 is emitted from the first-mode port 204 of the first OMT 200 and any second-mode remaining portion of the reverse signal ("$2^{nd}$ mode RRS") 218 of the remaining energy (if any) of the second-mode input signal 136 into the second OMT 202 is emitted from the second-mode port 206 of the first OMT 200.

It is appreciated by those of ordinary skill in the art that while FIGS. 1A through 2 illustrate the DAAS 100 having eight (8) first-mode directional couplers 104*a*, 104*b*, 104*c*, 104*d*, 104*e*, 104*f*, 104*g*, and 104*h* and eight (8) second-mode directional couplers 106*a*, 106*b*, 106*c*, 106*d*, 106*e*, 106*f*, 106*g*, and 106*h*, this is for ease of illustration only and it is appreciated that the DAAS 100 may include any plurality (i.e., two or more) of first-mode directional couplers and second-mode directional couplers without straying from the breath of the present disclosure.

It is also appreciated by those skilled in the art that the circuits, components, modules, and/or devices of, or associated with, the DAAS 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

Figure 3A:
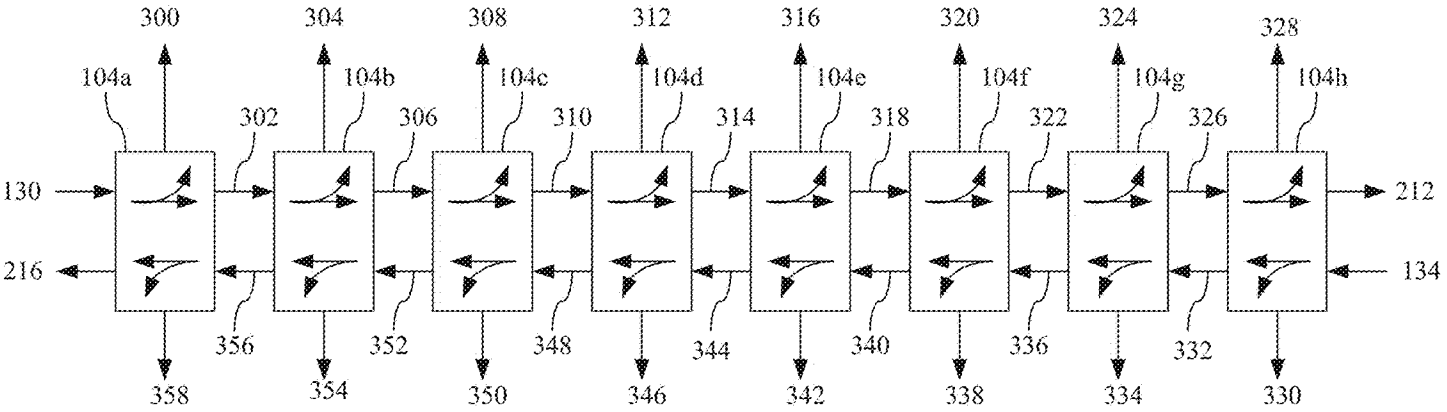
FIG. 3A is a block diagram of the example of operation of a plurality of the first-mode directional couplers and the ASF waveguide, shown in FIGS. 1A through 2, in accordance with the present disclosure.

FIG. 3A is a block diagram of the example of operation of the plurality of the first-mode directional couplers 104*a*, 104*b*, 104*c*, 104*d*, 104*e*, 104*f*, 104*g*, and 104*h* and the ASF waveguide 102 shown in FIGS. 1A through 2. As described earlier, the first-mode input signal 130 is injected into first-feed waveguide input 122 of the ASF waveguide 102. The ASF waveguide 102 then passes the first-mode input signal 130 to a first first-mode directional coupler ("$1^{st}$ FMDC") 104*a*, which produces a first first-mode forward coupled ("$1^{st}$ FMFC") signal 300 and passes it to a first port 108*a* of $1^{st}$ the FMDC 104*a*. A first remaining first-mode forward input ("$1^{st}$ RFMFI") signal 302 is then passed to a second first-mode directional coupler ("$2^{nd}$ FMDC") 104*b*, which produces a second first-mode forward coupled ("$2^{nd}$ FMFC") signal 304 and passes it to a first port 108*b* of the $2^{nd}$ FMDC 104*b*. A second remaining first-mode forward input ("$2^{nd}$ RFMFI") signal 306 is then passed to a third first-mode directional coupler ("$3^{rd}$ FMDC") 104*c*, which produces a third first-mode forward coupled ("$3^{rd}$ FMFC") signal 308 and passes it to a first port 108*c* of the $3^{rd}$ FMDC 104*c*. A third remaining first-mode forward input ("$3^{rd}$ RFMFI") signal 310 is then passed to a fourth first-mode directional coupler ("$4^{th}$ FMDC") 104*d*, which produces a fourth first-mode forward coupled ("$4^{th}$ FMFC") signal 312 and passes it to a first port 108*d* of the $4^{th}$ FMDC 104*d*. A fourth remaining first-mode forward input ("$4^{th}$ RFMFI") signal 314 is then passed to a fifth first-mode directional coupler ("$5^{th}$ FMDC") 104*e*, which produces a fifth first-mode forward coupled ("$5^{th}$ FMFC") signal 316 and passes it to a first port 108*e* of the $5^{th}$FMDC 104*e*. A fifth remaining first-mode forward input ("$5^{th}$ RFMFI") signal 318 is then passed to a sixth first-mode directional coupler ("$6^{th}$ FMDC") 104*f*, which produces a sixth first-mode forward coupled ("$6^{th}$ FMFC") signal 320 and passes it to a first port 108*f* of the $6^{th}$ FMDC 104*f*. A sixth remaining first-mode forward input ("6th RFMFI") signal 322 is then passed to a seventh first-mode directional coupler ("7th FMDC") 104*g*, which produces a seventh first-mode forward coupled ("7th FMFC") signal 324 and passes it to a first port 108*g* of the 7th FMDC 104*g*. Finally, a seventh remaining first-mode forward input ("7th RFMFI") signal 326 is then passed to an eighth first-mode directional coupler ("8th FMDC") 104*h*, which produces an eighth first-mode forward coupled ("8th FMFC") signal 328 and passes it to a first port 108*h* of the 8th FMDC 104*h*. The eighth remaining first-mode forward input signal is the 1st mode RS 212 that is then outputted from the ASF waveguide 102.

Similarly, the first-mode input signal 134 is injected into the second-feed waveguide input 124 of the ASF waveguide 102. The ASF waveguide 102 then passes the first-mode input signal 134 to the 8th FMDC 104*h*, which produces a first first-mode reverse coupled ("1st FMRC") signal 330 and passes it to a second port 110*h* of 8th FMDC 104*h*. A first remaining first-mode reverse input ("1st RFMRI") signal 332 is then passed to the 7th FMDC 104*g*, which produces a second first-mode reverse coupled ("2nd FMRC") signal 334 and passes it to a second port 110*g* of the 7th FMDC 104*g*. A second remaining first-mode reverse input ("2nd RFMRI") signal 336 is then passed to the 6th FMDC 104*f*, which produces a third first-mode reverse coupled ("3rd FMRC") signal 338 and passes it to a second port 110*f* of the 6th FMDC 104*f*. A third remaining first-mode reverse input ("3rd RFMRI") signal 340 is then passed to 5th FMDC 104*e*, which produces a fourth first-mode reverse coupled ("4th FMRC") signal 342 and passes it to a second port 110*e* of the 5th FMDC 104*e*. A fourth remaining first-mode reverse input ("4th RFMRI") signal 344 is then passed to the 4th FMDC 104*d*, which produces a fifth first-mode reverse coupled ("5th FMRC") signal 346 and passes it to a second port 110*d* of the 4th FMDC 104*d*. A fifth remaining first-mode reverse input ("5th RFMRI") signal 348 is then passed to the 3rd FMDC 104*c*, which produces a sixth first-mode reverse coupled ("6th FMRC") signal 350 and passes it to a second port 110*c* of the 3rd FMDC 104*c*. A sixth remaining first-mode reverse input ("6th RFMRI") signal 352 is then passed to 2nd FMDC 104*b*, which produces a seventh first-mode reverse coupled ("7th FMRC") signal 354 and passes it to a second port 110*b* of the 2nd FMDC 104*b*. Finally, a seventh remaining first-mode reverse input ("7th RFMRI") signal 356 is then passed to 1st FMDC 104*a*, which produces an eighth first-mode reverse coupled ("8th FMFC") signal 358 and passes it to a second port 110*a* of the 1st FMDC 104*a*. The eighth remaining first-mode reverse input signal is the 1st mode RRS 216 that is then outputted from the ASF waveguide 102.

Figure 3B:
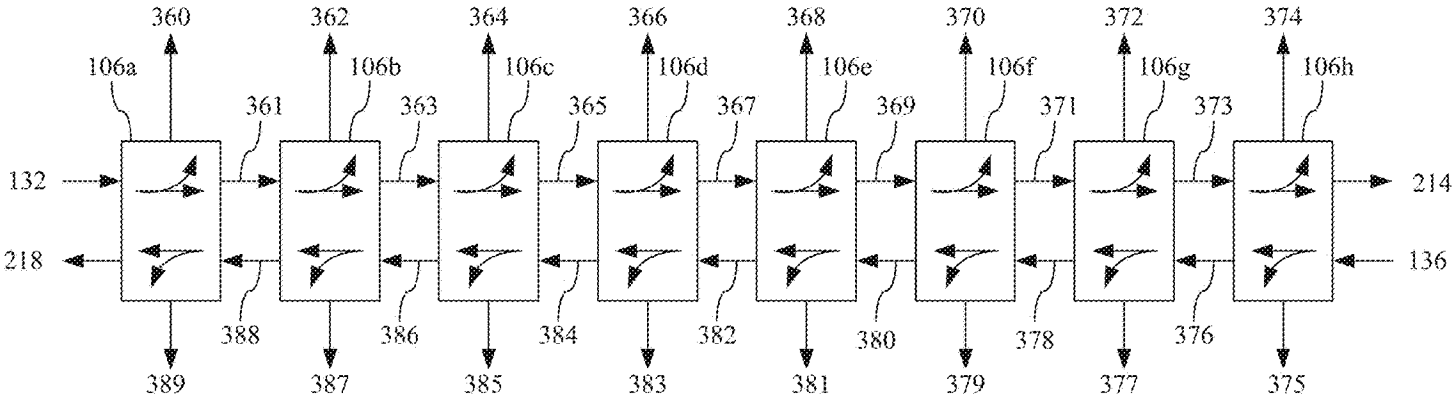
FIG. 3B is a block diagram of the example of operation of the plurality of a second-mode directional couplers and the ASF waveguide, shown in FIGS. 1A through 2, in accordance with the present disclosure.

In FIG. 3B, a block diagram of the example of operation of the plurality of the second-mode directional couplers 106*a*, 106*b*, 106*c*, 106*d*, 106*e*, 106*f*, 106*g*, and 106*h* and the ASF waveguide 102 shown in FIGS. 1A through 2. As described earlier, the second-mode input signal 132 is injected into first-feed waveguide input 122 of the ASF waveguide 102. The ASF waveguide 102 then passes the second-mode input signal 132 to a first second-mode directional coupler ("1st SMDC") 106*a*, which produces a first second-mode forward coupled ("1st SMFC") signal 360 and passes it to a first port 112*a* of 1st the SMDC 106*a*. A first remaining second-mode forward input ("1st RSMFI") signal 361 is then passed to a second second-mode directional coupler ("2nd SMDC") 106*b*, which produces a second second-mode forward coupled ("2nd SMFC") signal 362 and passes it to a first port 112*b* of the 2nd SMDC 106*b*. A second remaining second-mode forward input ("2nd RSMFI") signal 363 is then passed to a third second-mode directional coupler ("3rd SMDC") 106*c*, which produces a third second-mode forward coupled ("3rd SMFC") signal 364 and passes it to a first port 112*c* of the 3rd SMDC 106*c*. A third remaining second-mode forward input ("3rd RSMFI") signal 365 is then passed to a fourth second-mode directional coupler ("4th SMDC") 106*d*, which produces a fourth second-mode forward coupled ("4th SMFC") signal 366 and passes it to a first port 112*d* of the 4th SMDC 106*d*. A fourth remaining second-mode forward input ("4th RSMFI") signal 367 is then passed to a fifth second-mode directional coupler ("5th SMDC") 106*e*, which produces a fifth second-mode forward coupled ("5th SMFC") signal 368 and passes it to a first port 112*e* of the 5th SMDC 106*e*. A fifth remaining second-mode forward input ("5th RSMFI") signal 369 is then passed to a sixth second-mode directional coupler ("6th SMDC") 106*f*, which produces a sixth second-mode forward coupled ("6th SMFC") signal 370 and passes it to a first port 112*f* of the 6th SMDC 106*f*. A sixth remaining second-mode forward input ("6th RSMFI") signal 371 is then passed to a seventh second-mode directional coupler ("7th SMDC") 106*g*, which produces a seventh second-mode forward coupled ("7th SMFC") signal 372 and passes it to a first port 112*g* of the 7th SMDC 106*g*. Finally, a seventh remaining second-mode forward input ("7th RSMFI") signal 373 is then passed to an eighth second-mode directional coupler ("8th SMDC") 106*h*, which produces an eighth second-mode forward coupled ("8th SMFC") signal 374 and passes it to a first port 112*h* of the 8th SMDC 106*h*. The eighth remaining second-mode forward input signal is the 2nd mode RS 214 that is then outputted from the ASF waveguide 102.

Similarly, the second-mode input signal 136 is injected into the second-feed waveguide input 124 of the ASF waveguide 102. The ASF waveguide 102 then passes the second-mode input signal 136 to the 8th SMDC 106*h*, which produces a first second-mode reverse coupled ("1st SMRC") signal 375 and passes it to a second port 114*h* of the 8th SMDC 106*h*. A first remaining second-mode reverse input ("1st RSMRI") signal 376 is then passed to the 7th SMDC 106*g*, which produces a second second-mode reverse coupled ("2nd SMRC") signal 377 and passes it to a second port 114*g* of the 7th SMDC 106*g*. A second remaining second-mode reverse input ("2nd RSMRI") signal 378 is then passed to the 6th SMDC 106*f*, which produces a third second-mode reverse coupled ("3rd SMRC") signal 379 and passes it to a second port 114*f* of the 6th SMDC 106*f*. A third remaining second-mode reverse input ("3rd RSMRI") signal 380 is then passed to 5th SMDC 106*e*, which produces a fourth second-mode reverse coupled ("4th SMRC") signal 381 and passes it to a second port 114*e* of the 5th SMDC 106*e*. A fourth remaining second-mode reverse input ("4th RSMRI") signal 382 is then passed to the 4th SMDC 106*d*, which produces a fifth second-mode reverse coupled ("5th SMRC") signal 383 and passes it to a second port 114*d* of the 4th SMDC 106*d*. A fifth remaining second-mode reverse input ("5th RSMRI") signal 384 is then passed to the 3rd SMDC 106*c*, which produces a sixth second-mode reverse coupled ("6th SMRC") signal 385 and passes it to a second port 114*c* of the 3rd SMDC 106*c*. A sixth remaining second-mode reverse input ("6th RSMRI") signal 386 is then passed to 2nd SMDC 106*b*, which produces a seventh second-mode reverse coupled ("7th SMRC") signal 387 and passes it to a second port 114*b* of the 2nd SMDC 106*b*. Finally, a seventh remaining second-mode reverse input ("7th RSMRI") signal 388 is then passed to 1st SMDC 106*a*, which produces an eighth second-mode reverse coupled ("8th SMFC") signal 389 and passes it to a second port 114*a* of the 1st SMDC 106*a*. The eighth remaining first-mode reverse input signal is the $2^{nd}$ mode RRS 218 that is then outputted from the ASF waveguide 102.

Figure 4A:
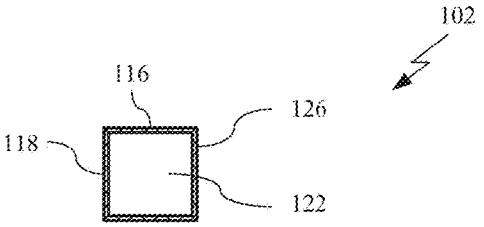
FIG. 4A is a front view of the ASF waveguide looking into a first-feed waveguide input at a first-end of the ASF waveguide in accordance with the present disclosure.
Figure 4B:
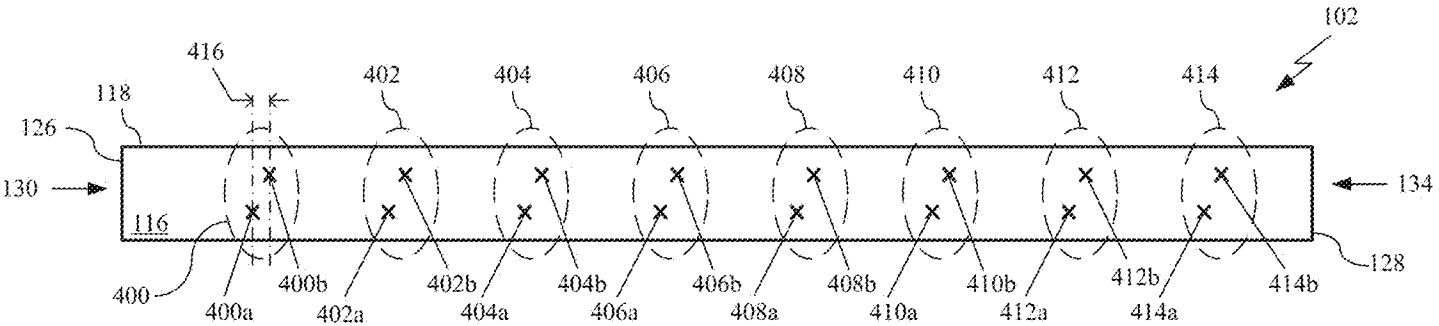
FIG. 4B is a back side view of an example of an implementation of the ASF waveguide in accordance with the present disclosure.
Figure 4C:
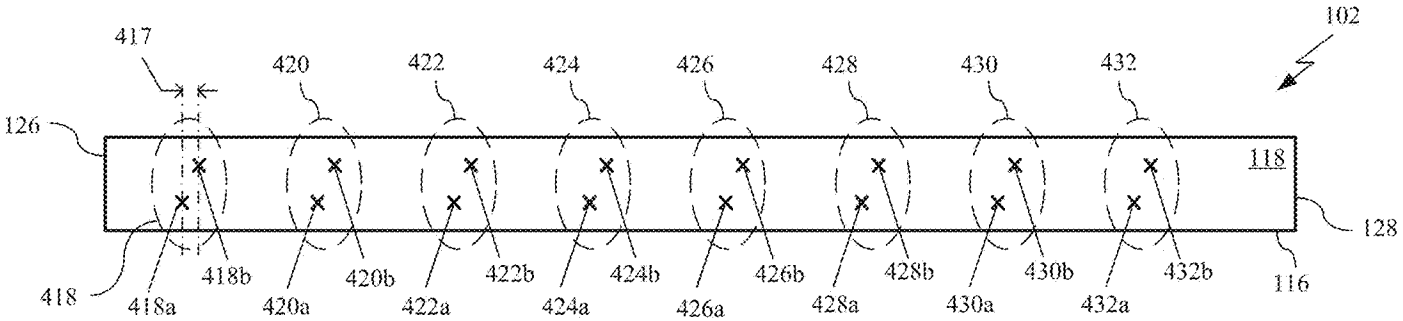
FIG. 4C is a top view of an example of an implementation of the ASF waveguide in accordance with the present disclosure.

Turning to FIGS. 4A through 4C, various views of an example of an implementation of the ASF waveguide 102 is shown in accordance with the present disclosure. Specifically, in FIG. 4A, a front view of the ASF waveguide 102 looking into the first-feed waveguide input 122 at the first-end 126 of the ASF waveguide 102 is shown in accordance with the present disclosure.

In FIG. 4B, a back side view of an example of an implementation of the ASF waveguide 102 is shown in accordance with the present disclosure. The ASF waveguide 102 includes the first ASF waveguide wall 116 and a plurality of first-mode planar coupling ("FMPC") slots that are organized into a plurality of pairs of FMPC slots 400, 402, 404, 406, 408, 410, 412, and 414 and are cut into the first ASF waveguide wall 116.

In this example, the first pair of FMPC slots 400 corresponds to the $1^{st}$ FMDC 104*a*, second pair of FMPC slots 402 corresponds to the $2^{nd}$ FMDC 104*b*, third pair of FMPC slots 404 corresponds to the $3^{rd}$ FMDC 104*c*, fourth pair of FMPC slots 406 corresponds to the $4^{th}$ FMDC 104*d*, fifth pair of FMPC slots 408 corresponds to the $5^{th}$ FMDC 104*e*, sixth pair of FMPC slots 410 corresponds to the $6^{th}$ FMDC 104*f*, seventh pair of FMPC slots 412 corresponds to the $7^{th}$ FMDC 104*g*, and eighth pair of FMPC slots 414 corresponds to the $8^{th}$ FMDC 104*h*. Moreover, the first pair of FMPC slots 400 includes a first slot 400*a* and second slot 400*b*, the second pair of FMPC slots 402 includes a first slot 402*a* and second slot 402*b*, the third pair of FMPC slots 404 includes a first slot 404*a* and second slot 404*b*, the fourth pair of FMPC slots 406 includes a first slot 406*a* and second slot 406*b*, the fifth pair of FMPC slots 408 includes a first slot 408*a* and second slot 408*b*, the sixth pair of FMPC slots 410 includes a first slot 410*a* and second slot 410*b*, the seventh pair of FMPC slots 412 includes a first slot 412*a* and second slot 412*b*, and the eighth pair of FMPC slots 414 includes a first slot 414*a* and second slot 414*b*. In general, the first slot 400*a*, 402*a*, 404*a*, 406*a*, 408*a*, 410*a*, 412*a*, and 414*a* and second slot 400*b*, 402*b*, 404*b*, 406*b*, 408*b*, 410*b*, 412*b*, and 414*b* (of every pair of FMPC slots 400, 402, 404, 406, 408, 410, 412, and 414) is spaced 416 apart approximately a quarter wavelength of the operating frequency of first-mode of operation.

In this example, the planar coupling slots (i.e., the first slot 400*a*, 402*a*, 404*a*, 406*a*, 408*a*, 410*a*, 412*a*, and 414*a* and second slot 400*a*, 402*b*, 404*b*, 406*b*, 408*b*, 410*b*, 412*b*, and 414*b*) of the plurality of pairs of FMPC slots (400, 402, 404, 406, 408, 410, 412, and 414) are radiating slots that radiate energy out from the ASF waveguide 102 in the first-mode of operation. The plurality of pairs of FMPC slots 400, 402, 404, 406, 408, 410, 412, and 414 are cut into the first ASF waveguide wall 116 and into the corresponding adjacent bottom walls of the corresponding FMDC (104*a*, 104*b*, 104*c*, 104*d*, 104*e*, 104*f*, 104*g*, and 104*h*). It is appreciated by those skilled in the art that the ASF waveguide 102 is constructed of a conductive material such as metal and defines an approximately square tube that has an internal cavity running the ASF waveguide length 120 of the ASF waveguide 102 that may be filled with air, dielectric material, or both.

In an example of operation, when the first-mode input signal 130 at the first-feed waveguide input 122 and first-mode input signal 134 at the second-feed waveguide input 124 (i.e., at the second-end 128 of the ASF waveguide 102) are injected (i.e., inputted) into the ASF waveguide 102 they excite both magnetic and electric fields within the ASF waveguide 102. Assuming that the first-mode input signal 130 at the first-feed waveguide input 122 and the first-mode input signal 134 at the second-feed waveguide input 124 are $TE_{10}$ mode signals, this gives rise to induced currents in the walls (i.e., first ASF waveguide wall 116, second ASF waveguide wall 118, and third ASF waveguide wall 138) of the ASF waveguide 102 that are at right angles to the magnetic field.

Figure 5A:
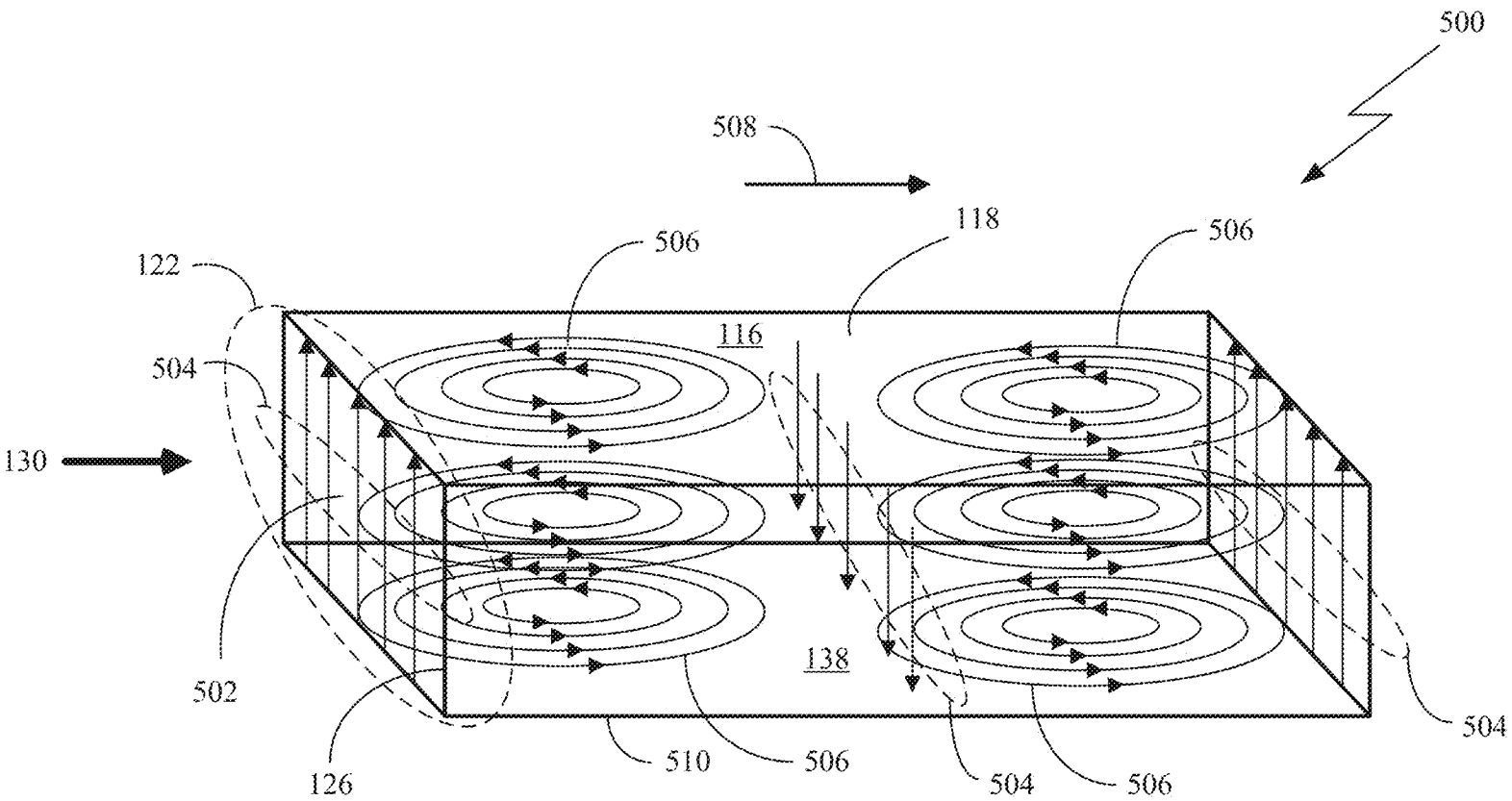
FIG. 5A is a perspective-side view of a portion of the ASF waveguide in accordance with the present disclosure.

As an example, in FIG. 5A, a perspective-side view of a portion 500 of the ASF waveguide 102 is shown. In this example, the first-mode input signal 130 is injected into the cavity 502 of the ASF waveguide 102 at the first-feed waveguide input 122 (at the first-end 126 of the feed waveguide 102). If the first-mode input signal 130 is a $TE_{10}$ mode signal, it will induce an electric field 504 that is directed along the vertical direction of the second ASF waveguide wall 118 and third ASF waveguide wall 138 (i.e., normal to the first ASF waveguide wall 116) of the ASF waveguide 102 and a magnetic field 506 that is perpendicular to the electric field 504 and forms loops along the direction of propagation 508, which are parallel to the first ASF waveguide wall 116 and a fourth ASF waveguide wall 510 (that is opposite the first waveguide wall 116) and tangential to the second ASF waveguide wall 118 and third ASF waveguide wall 138. It is appreciated by those of ordinary skill in the art that for the $TE_{10}$ mode, the electric field 504 varies in a sinusoidal fashion as a function of distance along the direction of propagation 508.

Figure 5B:
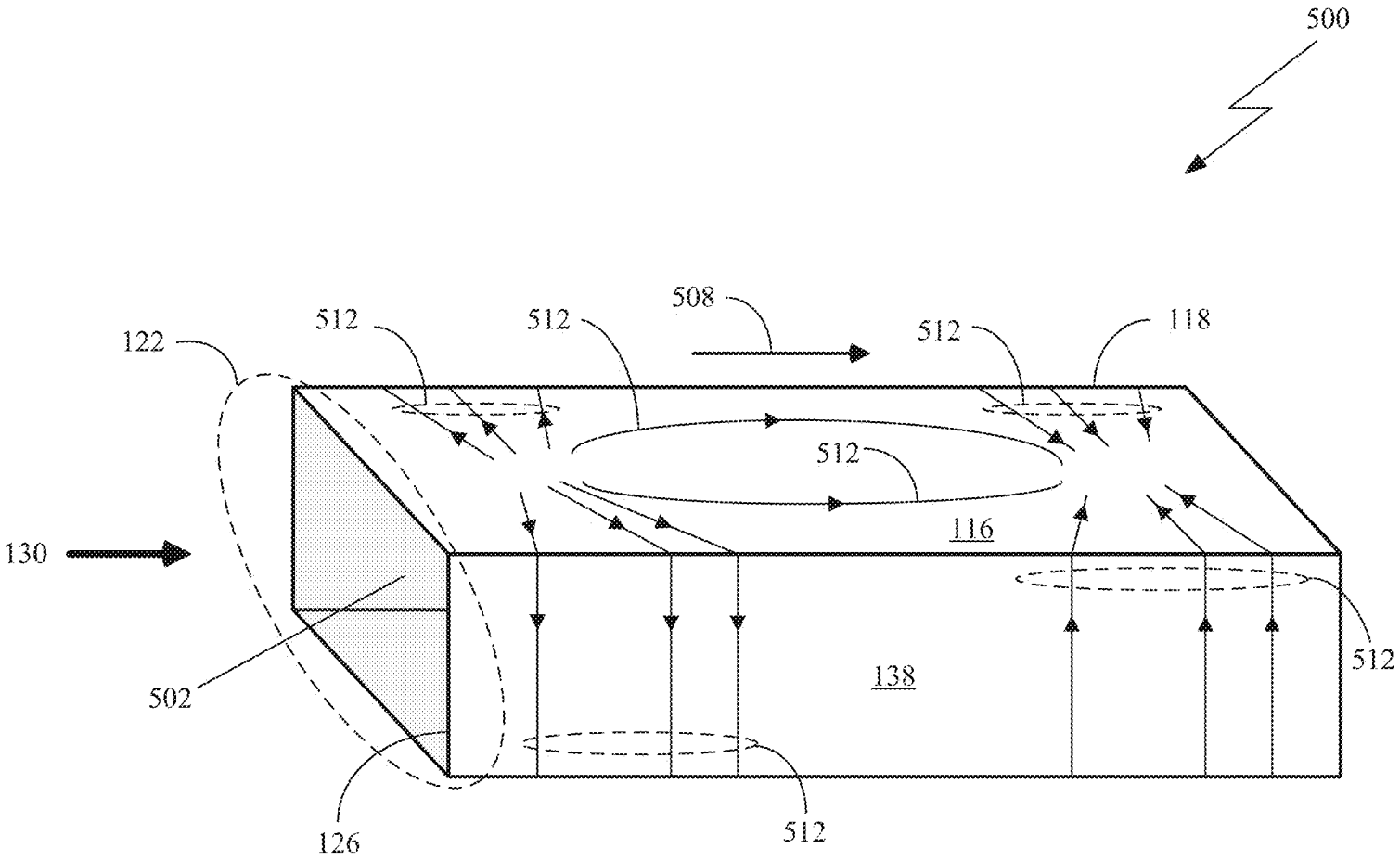
FIG. 5B is a perspective-side view of the portion of the ASF waveguide with resulting induced currents in the $TE_{10}$ mode along a first ASF waveguide wall and second ASF waveguide wall that is produced by a first-mode input signal in accordance with the present disclosure.

In FIG. 5B, a perspective-side view of the portion 500 of the ASF waveguide 102 is shown with the resulting induced currents 512 in the $TE_{10}$ mode along the first ASF waveguide wall 116 and second ASF waveguide wall 118 (it is appreciated that induced currents are also produced on the third ASF waveguide wall 138 and fourth ASF waveguide wall 510) that is produced by the first-mode input signal 130. Expanding on this concept, in the ASF waveguide 102 shown in FIG. 4B, a plurality of magnetic field loops (such as magnetic field loops 500 of FIG. 5A) are excited along the ASF waveguide length 120 of the ASF waveguide 102. The magnetic field loops are caused by the propagation of the first-mode input signal 130 along the ASF waveguide length 120 of the ASF waveguide 102. It is noted that in FIGS. 4A and 5A the examples were described in relation to the first-mode input signal 130; however, it is appreciated by those of ordinary skill in the art that by reciprocity the same examples hold true for describing the electric fields, magnetic fields, and the induced currents along the ASF waveguide 102 for the first-mode input signal 134 at the second-feed waveguide input 124. The only difference is that the polarities will be opposite because of the opposite direction of propagation of the first-mode input signal 134 in relation to the first-mode input signal 130.

In FIG. 4C, a top view of an example of an implementation of the ASF waveguide 102 is shown in accordance with the present disclosure. The ASF waveguide 102 includes the second ASF waveguide wall 118 and a plurality of second-mode planar coupling ("SMPC") slots that are organized into a plurality of pairs of SMPC slots 418, 420, 422, 424, 426, 428, 430, and 432 and are cut into the second ASF waveguide wall 118.

In this example, the first pair of SMPC slots 418 corresponds to the $1^{st}$ SMDC 106*a*, second pair of SMPC slots 420 corresponds to the $2^{nd}$ SMDC 106*b*, third pair of SMPC slots 422 corresponds to the $3^{rd}$ SMDC 106*c*, fourth pair of SMPC slots 424 corresponds to the $4^{th}$ SMDC 106*d*, fifth pair of SMPC slots 426 corresponds to the $5^{th}$ SMDC 106*e*, sixth pair of SMPC slots 428 corresponds to the $6^{th}$ SMDC 106*f*, seventh pair of SMPC slots 430 corresponds to the $7^{th}$ SMDC 106*g*, and eighth pair of SMPC slots 432 corresponds to the $8^{th}$ SMDC 106*h*. Moreover, the first pair of SMPC slots 418 includes a first slot 418*a* and second slot 418*b*, the second pair of SMPC slots 420 includes a first slot 420*a* and second slot 420*b*, the third pair of FMPC slots 422 includes a first slot 422*a* and second slot 422*b*, the fourth pair of SMPC slots 424 includes a first slot 424*a* and second slot 424*b*, the fifth pair of SMPC slots 426 includes a first slot 426*a* and second slot 426*b*, the sixth pair of SMPC slots 428 includes a first slot 428*a* and second slot 428*b*, the seventh pair of SMPC slots 430 includes a first slot 430*a* and second slot 430*b*, and the eighth pair of SMPC slots 432 includes a first slot 432*a* and second slot 432*b*. In general, the first slot 418*a*, 420*a*, 422*a*, 424*a*, 426*a*, 428*a*, 430*a*, and 432*a* and second slot 418*b*, 420*b*, 422*b*, 424*b*, 426*b*, 428*b*, 430*b*, and 432*b* (of every pair of SMPC slots 418, 420, 422, 424, 426, 428, 430, and 432) is spaced 417 apart approximately a quarter wavelength of the operating frequency of second-mode of operation.

In this example, the planar coupling slots (i.e., the first slot 418*a*, 420*a*, 422*a*, 424*a*, 426*a*, 428*a*, 430*a*, and 432*a* and second slot 418*b*, 420*b*, 422*b*, 424*b*, 426*b*, 428*b*, 430*b*, and 432*b*) of the plurality of pairs of SMPC slots 418, 420, 422, 424, 426, 428, 430, and 432 are radiating slots that radiate energy out from the ASF waveguide 102 in the second-mode of operation. The plurality of pairs of SMPC slots 418, 420, 422, 424, 426, 428, 430, and 432 are cut into the second ASF waveguide wall 118 and into the corresponding adjacent bottom walls of the corresponding SMDC (106*a*, 106*b*, 106*c*, 106*d*, 106*e*, 106*f*, 106*g*, and 106*h*). As stated previously, it is appreciated by those skilled in the art that the ASF waveguide 102 is constructed of a conductive material such as metal and defines an approximately square tube that has the internal cavity 502 running the ASF waveguide length 120 of the ASF waveguide 102 that may be filled with air, dielectric material, or both.

Figure 6A:
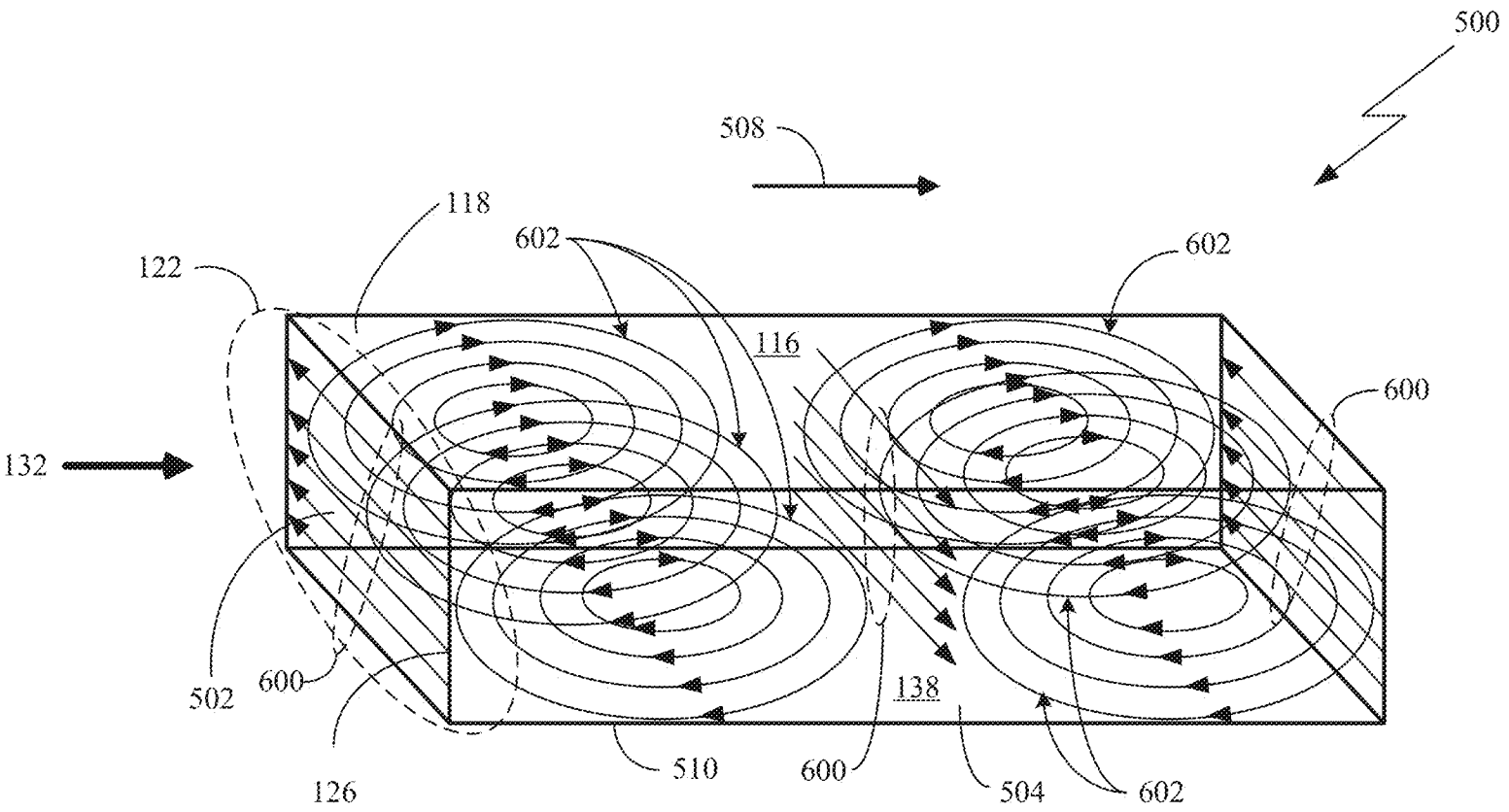
FIG. 6A is a perspective-side view of the portion of the ASF waveguide in accordance with the present disclosure.

As an example, in FIG. 6A, a perspective-side view of the portion 500 of the ASF waveguide 102 is shown. In this example, the second-mode input signal 132 is injected into the cavity 502 of the ASF waveguide 102 at the first-feed waveguide input 122 (at the first-end 126 of the feed waveguide 102). If the second-mode input signal 132 is a $TE_{01}$ mode signal, it will induce an electric field 600 that is directed along the vertical direction of the first ASF waveguide wall 116 and fourth ASF waveguide wall 510 (i.e., normal to the second ASF waveguide wall 118 and third ASF waveguide wall 138) of the ASF waveguide 102 and a magnetic field 602 that is perpendicular to the electric field 600 and forms loops along the direction of propagation 508, which are parallel to the second ASF waveguide wall 118 and the third ASF waveguide wall 138 and tangential to the first ASF waveguide wall 116 and fourth ASF waveguide wall 510. It is appreciated by those of ordinary skill in the art that for the $TE_{01}$ mode, the electric field 514 varies in a sinusoidal fashion as a function of distance along the direction of propagation 508.

Figure 6B:
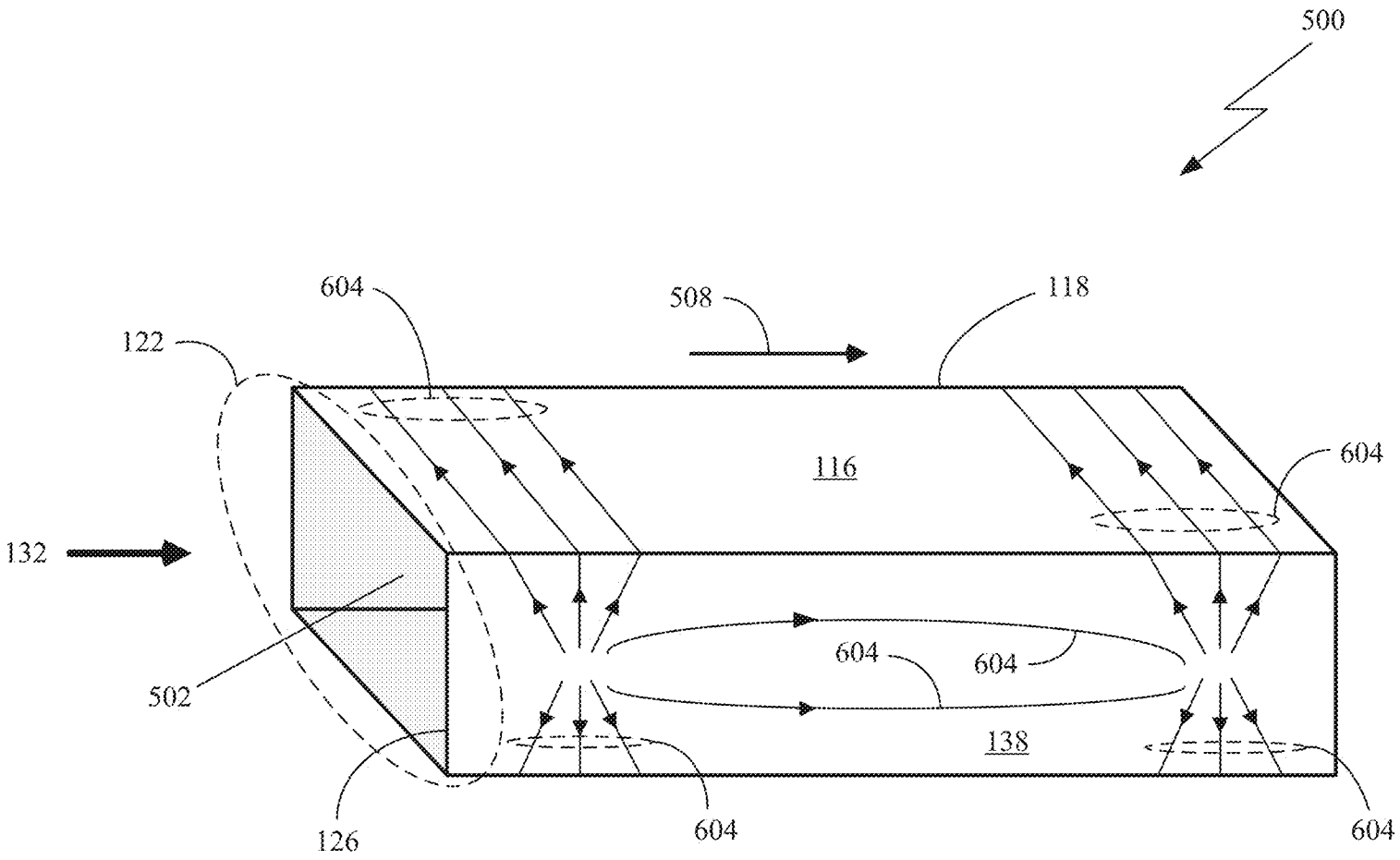
FIG. 6B is a perspective-side view of the portion of the ASF waveguide with the resulting induced currents in the $TE_{01}$ mode along the first ASF waveguide wall and third ASF waveguide wall that is produced by a second-mode input signal in accordance with the present disclosure.

In FIG. 6B, a perspective-side view of the portion 500 of the ASF waveguide 102 is shown with the resulting induced currents 604 in the $TE_{01}$ mode along the first ASF waveguide wall 116 and third ASF waveguide wall 138 (it is again appreciated that induced currents are also produced on the second ASF waveguide wall 118 and the fourth ASF waveguide wall 510) that is produced by the second-mode input signal 132. Expanding on this concept, in the ASF waveguide 102 shown in FIG. 4B, a plurality of magnetic field loops (such as magnetic field loops 602 of FIG. 6A) are excited along the ASF waveguide length 120 of the ASF waveguide 102. The magnetic field loops are caused by the propagation of the second-mode input signal 132 along the ASF waveguide length 120 of the ASF waveguide 102. It is again noted that in FIGS. 4B and 6B, the examples were described in relation to the second-mode input signal 132; however, it is appreciated by those of ordinary skill in the art that by reciprocity the same examples hold true for describing the electric fields, magnetic fields, and the induced currents along the ASF waveguide 102 for the second-mode input signal 136 at the second-feed waveguide input 124. The only difference is that the polarities will be opposite because of the opposite direction of propagation of the second-mode input signal 136 in relation to the second-mode input signal 130.

Turning back to FIGS. 4B and 4C, each planar coupling slot is designed to interrupt the current flow of the induced currents 512 or 604 in walls of the ASF waveguide 102 and as a result produce a disturbance of the internal electric field 504 or 600 and magnetic field 506 or 602 that results in energy being radiated from the cavity 502 of the ASF waveguide 102 to the external environment of the ASF waveguide 102, i.e., coupling energy from the ASF waveguide 102 to the external environment that in this example includes the plurality of FMDCs 104*a*, 104*b*, 104*c*, 104*d*, 104*e*, 104*f*, 104*g*, and 104*h* and plurality of SMDCs 106*a*, 106*b*, 106*c*, 106*d*, 106*e*, 106*f*, 106*g*, and 106*h*.

In this disclosure, the plurality of first ports 108*a*, 108*b*, 108*c*, 108*d*, 108*e*, 108*f*, 108*g*, 108*h*, 112*a*, 112*b*, 112*c*, 112*d*, 112*e*, 112*f*, 112*g*, and 112*h* and the plurality of second ports 110*a*, 110*b*, 110*c*, 110*d*, 110*e*, 110*f*, 110*g*, 110*h*, 114*a*, 114*b*, 114*c*, 114*d*, 114*e*, 114*f*, 114*g*, and 114*h* may be in signal communication with a plurality of first-mode radiating elements and a plurality of second-mode radiating elements, respectively. In this example, the plurality of first-mode radiating elements may be configured to produce a first polarized signal from the received first-mode input signal 130 at the first-feed waveguide input 122 and a second polarized signal from the received first-mode input signal 134 at the second-feed waveguide input 124, where the second polarized signal is cross-polarized with the first polarized signal. Specifically, each first-mode radiating element may be configured to produce the first polarized signal from the received first-mode input signal 130 at the first-feed waveguide input 122 and the second polarized signal from the received first-mode input signal 134 at the second-feed waveguide input 124.

Similarly, the plurality of second-mode radiating elements may be configured to produce a third polarized signal from the received second-mode input signal 132 at the first-feed waveguide input 122 and a fourth polarized signal from the received second-mode input signal 136 at the second-feed waveguide input 124, where the fourth polarized signal is cross-polarized with the third polarized signal. Moreover, each second-mode radiating element may be configured to produce the third polarized signal from the received first-mode input signal 132 at the first-feed waveguide input 122 and the fourth polarized signal from the received second-mode input signal 136 at the second-feed waveguide input 124.

In these examples, each first-mode radiating element and each second-mode radiating element may be include, or be, a horn antenna. Furthermore, the third polarized signal may be co-polarized with the first polarized signal and the fourth polarized signal may be co-polarized with the second polarized signal. Moreover, wherein the first slot and the second slot of each pair of FMPC slots 400, 402, 404, 406, 408, 410, 412, and 414 and each pair of SMPC slots 418, 420, 422, 424, 426, 428, 430, and 432 may have a geometry that is chosen from the group consisting of a slot, crossed-slot, and circular orifices.

It is appreciated by those of ordinary skill in the art that in the examples shown in FIGS. 1A through 6B, all of the FMDCs 104*a*, 104*b*, 104*c*, 104*d*, 104*e*, 104*f*, 104*g*, and 104*h* of the plurality of FMDCs and all of the SMDCs 106*a*, 106*b*, 106*c*, 106*d*, 106*e*, 106*f*, 106*g*, and 106*h* of the plurality of SMDCs are shown a being straight waveguides, however, in order to better direct the plurality of first-mode radiating elements and plurality of second-mode radiating elements, each of the FMDCs and SMDCs may include one or more bends.

Figure 7:
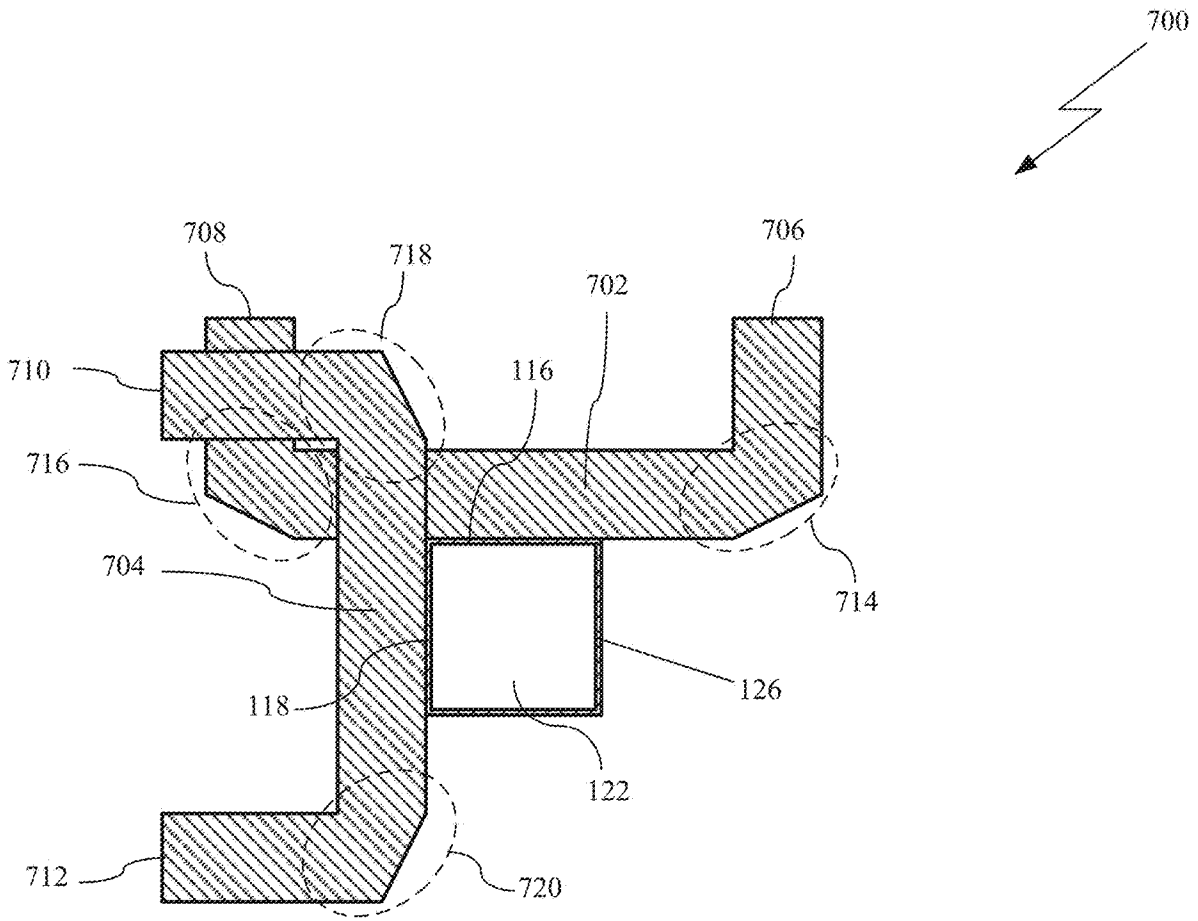
FIG. 7 is a front view of an example of another implementation of the DAAS in accordance with the present disclosure.

As an example, in FIG. 7, a front view of an example of another implementation of the DAAS 700 is shown in accordance with the present disclosure. In this example, the DAAS 700 is shown having a bent FMDC 702 and a bent SMDC 704, where the bent FMDC 702 is adjacent to the first ASF waveguide wall 116 and the bent SMDC 704 is adjacent to the second ASF waveguide wall 118. In this example, the first port 706 and second port 708 of the bent FMDC 702 are directed in a direction normal to the first ASF waveguide wall 116 and the first port 710 and second port 712 of the bent SMDC 704 are directed in a direction normal to the second ASF waveguide wall 118. Moreover, the bent FMDC 702 includes two bends (a first bend 714 and a second bend 716) and the bent SMDC 704 also includes two bends (a first bend 718 and a second bend 720).

Figure 8:
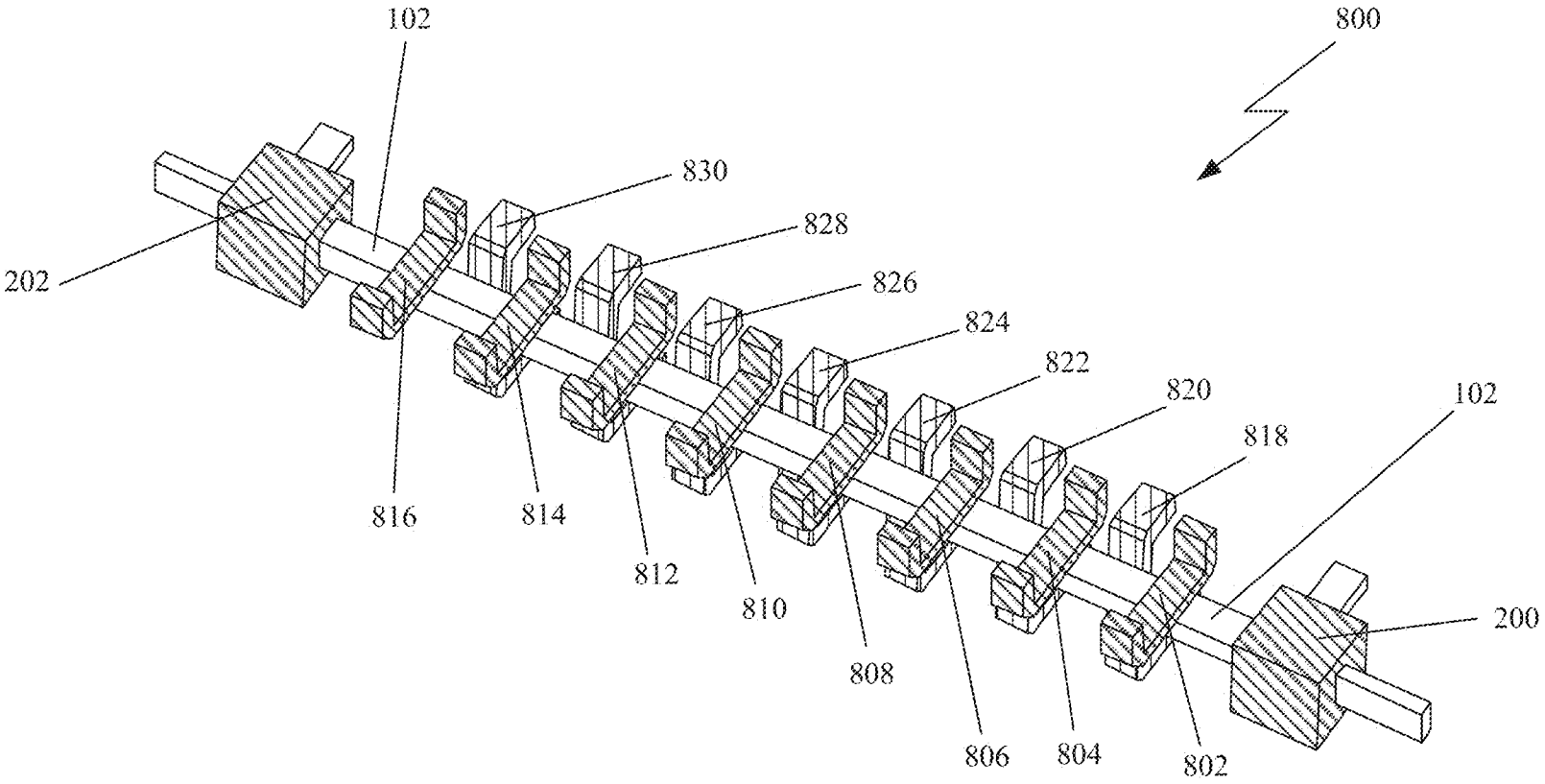
FIG. 8 is a perspective view of an example of another implementation of the DAAS in accordance with the present disclosure.

Based on this example, in FIG. 8, a perspective view of an example of another implementation of the DAAS 800 is shown in accordance with the present disclosure. In this example, the DAAS 800 includes the ASF waveguide 102, first OMT 200, and second OMT 202. The DAAS 800 also includes a plurality of bent FMDCs 802, 804, 806, 808, 810, 812, 814, and 816 and a plurality of bent SMDCs 818, 820, 822, 824, 826, 828, and 830.

Figure 9:
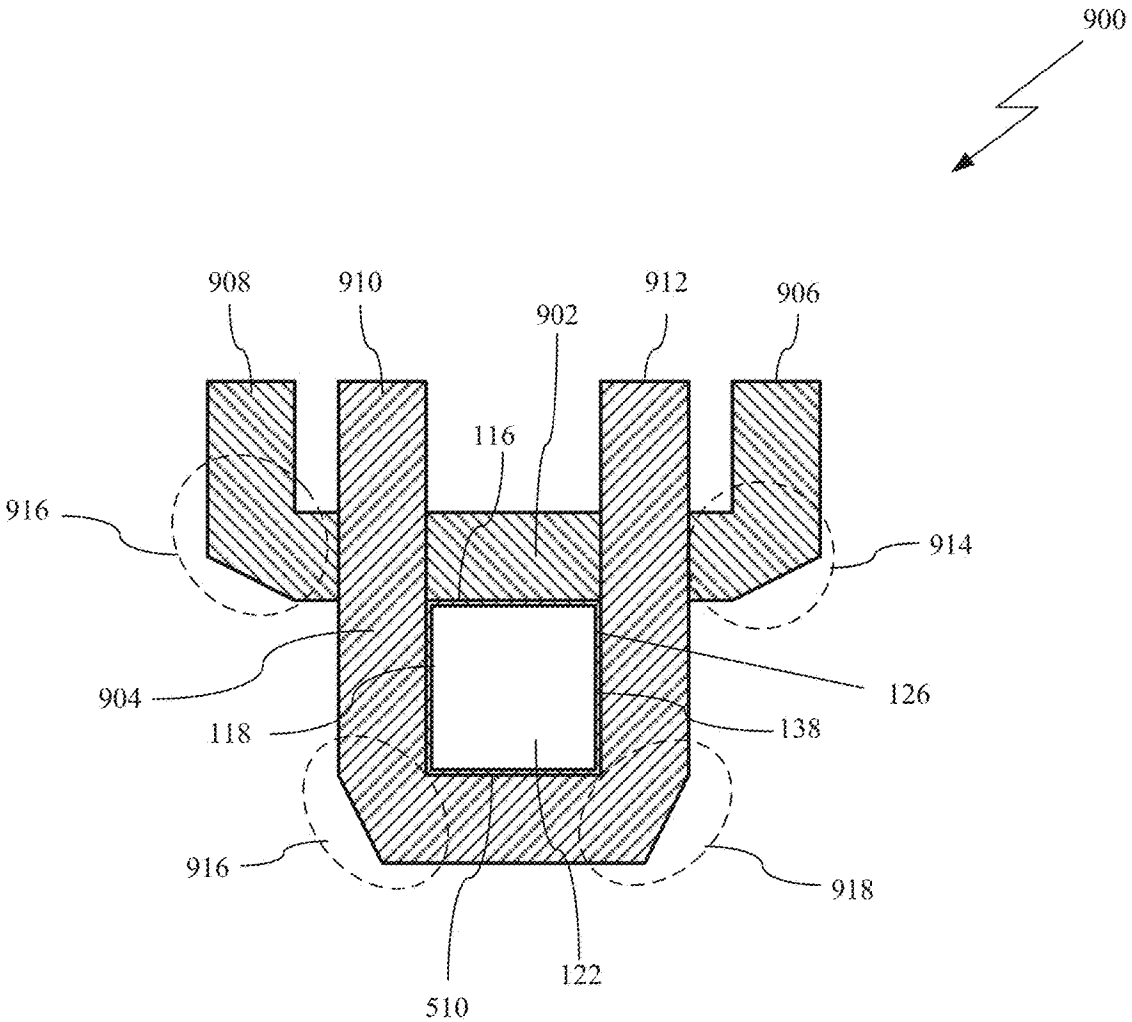
FIG. 9 is a front view of an example of yet another implementation of the DAAS in accordance with the present disclosure.

In FIG. 9, a front view of an example of yet another implementation of the DAAS 900 is shown in accordance with the present disclosure. In this example, the DAAS 900 is shown having a bent FMDC 902 and a bent SMDC 904, where the bent FMDC 902 is adjacent to the first ASF waveguide wall 116 and the bent SMDC 904 is adjacent to the second ASF waveguide wall 118, third ASF waveguide wall 138, and fourth ASF waveguide 510. Unlike the example shown in FIG. 8, in this example, the first port 906 and second port 908 of the bent FMDC 902 and the first port 910 and second port 912 of the bent SMDC 904 are both directed in a direction normal to the first ASF waveguide wall 116. Moreover, the bent FMDC 902 includes two bends (a first bend 914 and a second bend 916) and the bent SMDC 704 also includes two bends (a first bend 918 and a second bend 920).

Figure 10:
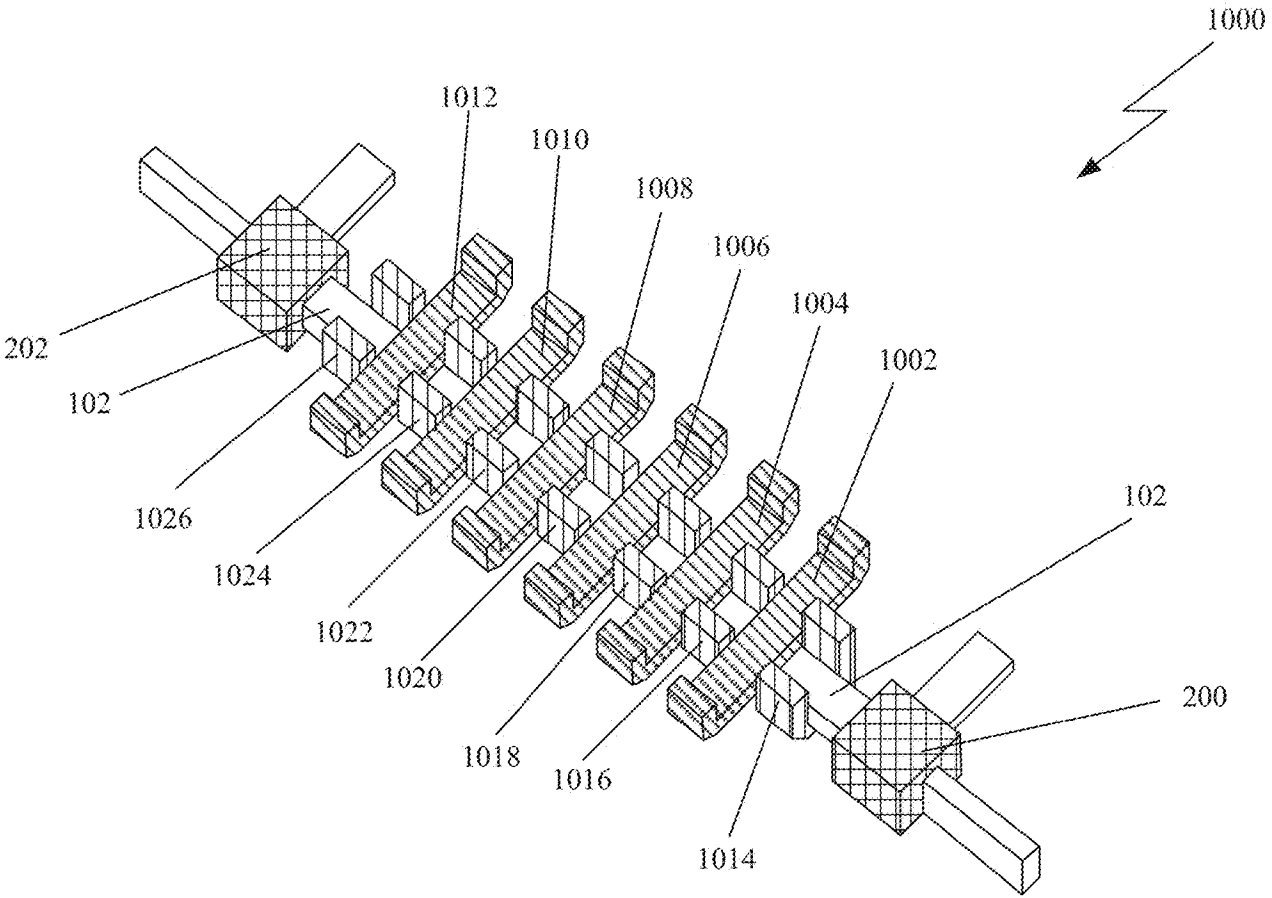
FIG. 10 is a perspective view of an example of still another implementation of the DAAS in accordance with the present disclosure.

Based on this example, in FIG. 10, a perspective view of an example of still another implementation of the DAAS 1000 is shown in accordance with the present disclosure. In this example, the DAAS 1000 includes the ASF waveguide 102, first OMT 200, and second OMT 202. The DAAS 1000 also includes a plurality of bent FMDCs 1002, 1004, 1006, 1008, 1010, and 1012 and a plurality of bent SMDCs 1014, 1016, 1018, 1020, 1022, 1024, and 1026. It is appreciated by those skilled in the art that other configurations of bent FMDCs and SMDCs may be utilized without departing from the breath of the present disclosure.

Figure 11:
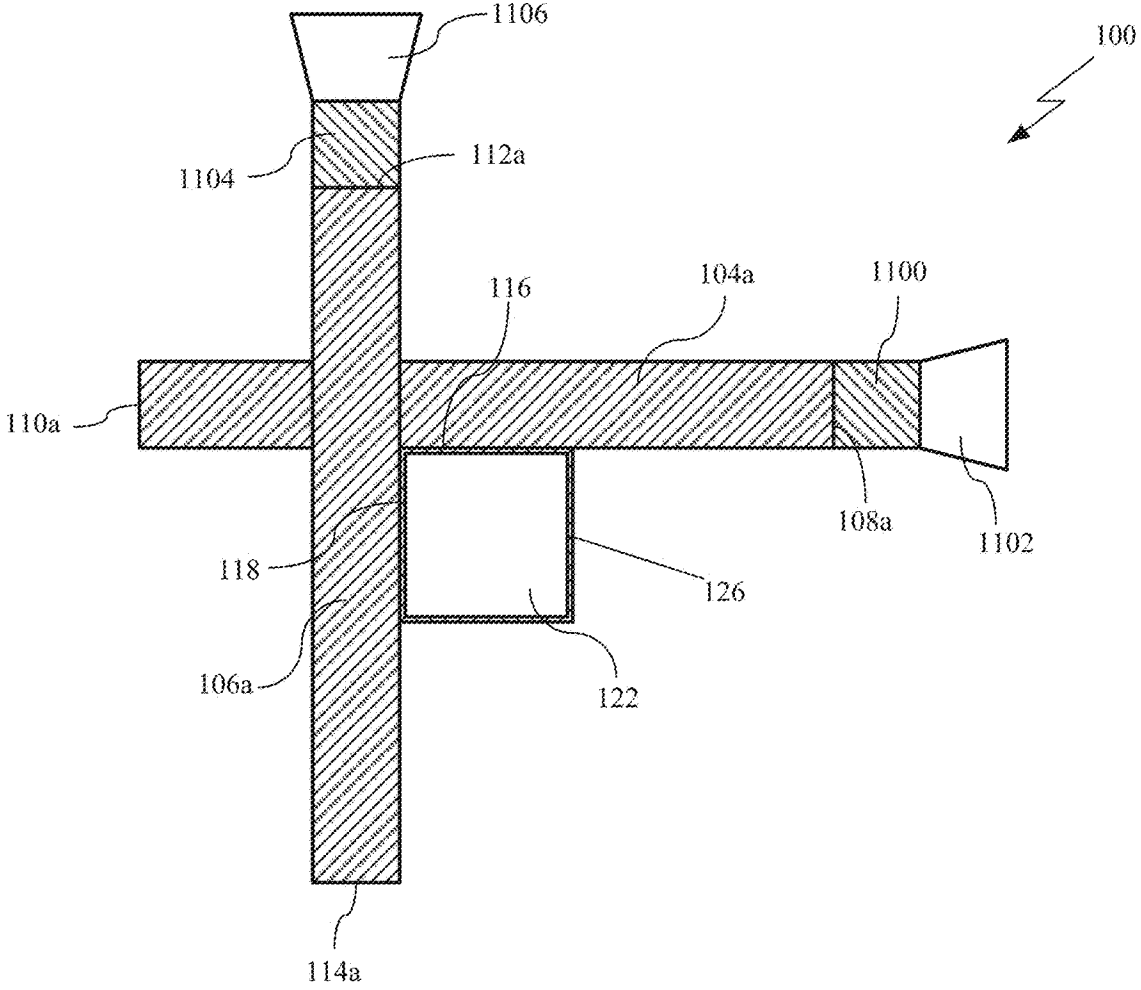
FIG. 11 is a front view of an example of the implementation of the DAAS, shown in FIG. 1B, having a first-mode power amplifier and corresponding first-mode horn antenna and a second-mode power amplifier and corresponding second-mode horn antenna in accordance with the present disclosure.

In FIG. 11, a front view of an example of the implementation of the DAAS 100, shown in FIG. 1B, having a first-mode power amplifier ("FMPA") 1100 and a corresponding first-mode horn antenna 1102 and a second-mode power amplifier ("SMPA") 1104 and corresponding second-mode horn antenna 1106 in accordance with the present disclosure.

The FMPA 1100 and the SMPA 1104 are power amplifiers that may be transmit and receive ("T/R") modules that may include a power amplifier, phase shifter, and other electronics that are designed to operate at frequency and bandwidth of operation of the DAAS 100. Moreover, the power amplifiers are designed to operate either in the first-mode or second-mode of operation (e.g., $TE_{10}$ for the FMPAs and $TE_{01}$ for the SMPAs). Furthermore, the first-mode horn antenna 1102 and second-mode horn antenna 1106 are aperture antennas, such as horn antennas, that have also been designed to operate either in the first-mode or second-mode of operation (e.g., $TE_{10}$ for the first-mode horn antenna and $TE_{01}$ for the second-mode horn antenna). It is appreciated by those of ordinary skill in the art that both the $TE_{10}$ and $TE_{01}$ modes are orthogonal modes that are commonly utilized in waveguide designs, however, other types of orthogonal TE or TM modes may also be utilized in the present disclosure without departing from the breath of present disclosure.

In this example, the FMPA 1100 is in signal communication with the first-mode horn antenna 1102 and the first port 108*a* of the 1st FMDC 104*a* and the SMPA 1102 is in signal communication with the second-mode horn antenna 1106 and the first port 112*a* of the 1st SMDC 106*a*. Moreover, in this example, the second port 110*a* of the 1st FMDC 104*a* and the second port 114*a* of the 1st SMDC 106*a* are shown as not having a FMRE or SMRE. The reason for this is that in this example, the second port 110*a* of the 1st FMDC 104*a* and the second port 114*a* of the 1st SMDC 106*a* may be terminated with other non-radiating electronics or matched loads such that only the first port 108*a* of the 1st FMDC 104*a* and the first port 112*a* of the 1st SMDC 106*a* are utilized to feed a FMRE (i.e., first-mode horn antenna 1102) and a SMRE (i.e., second-mode horn antenna 1106).

Figure 12:
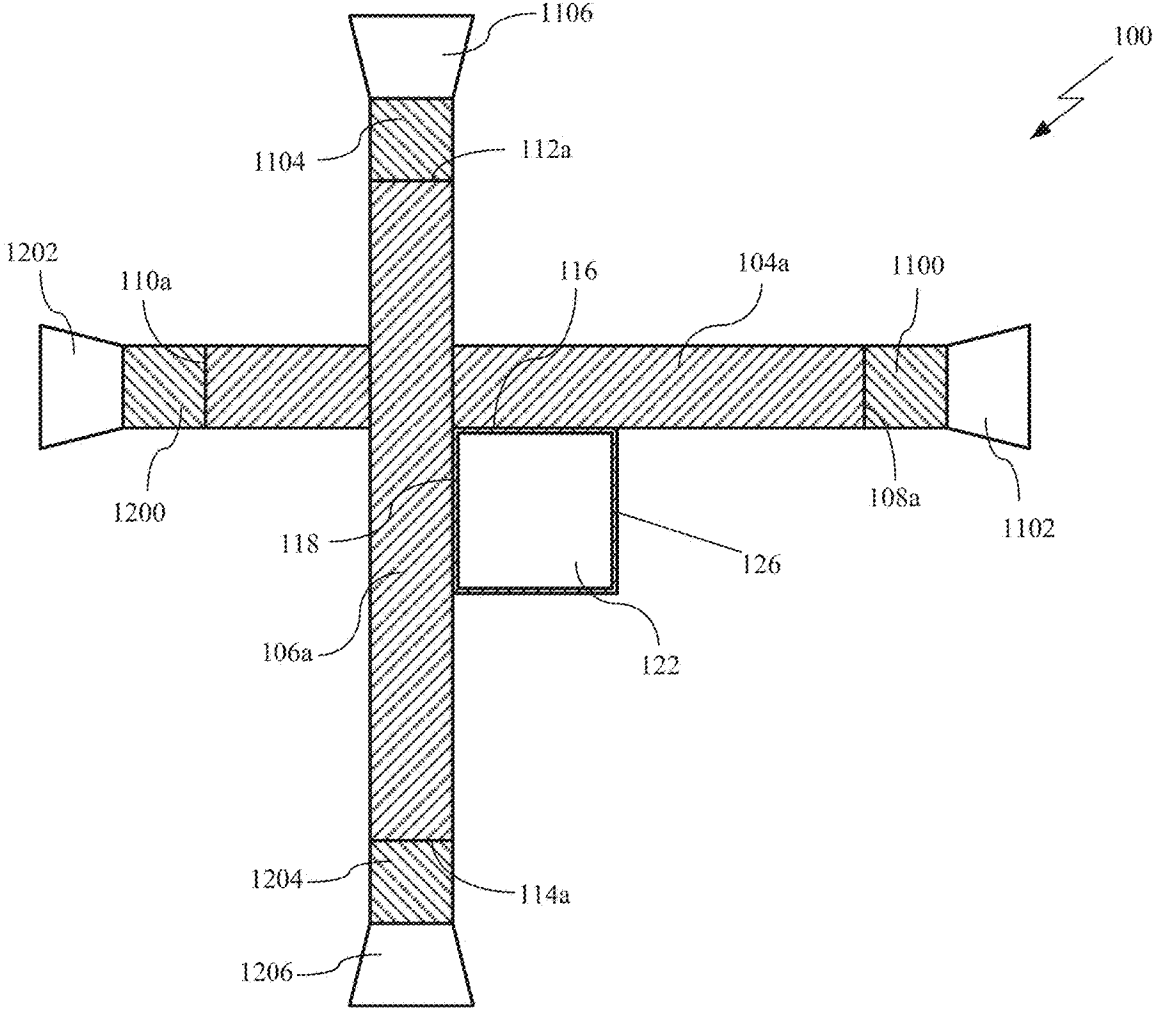
FIG. 12 is a front view of an example of the implementation of the DAAS, shown in FIG. 1B, having two first-mode power amplifiers and corresponding first-mode horn antennas and two second-mode power amplifiers and corresponding second-mode horn antennas in accordance with the present disclosure.

Alternatively, in FIG. 12, a front view of an example of the implementation of the DAAS 100 is shown having two first-mode power amplifiers (i.e., first FMPA 1100 and second FMPA 1200) and corresponding first-mode horn antennas (i.e., 1102 and 1202) and two second-mode power amplifiers (i.e., first SMPA 1104 and second SMPA 1204) and corresponding second-mode horn antennas (i.e., 1106 and 1206) in accordance with the present disclosure.

Figure 13:
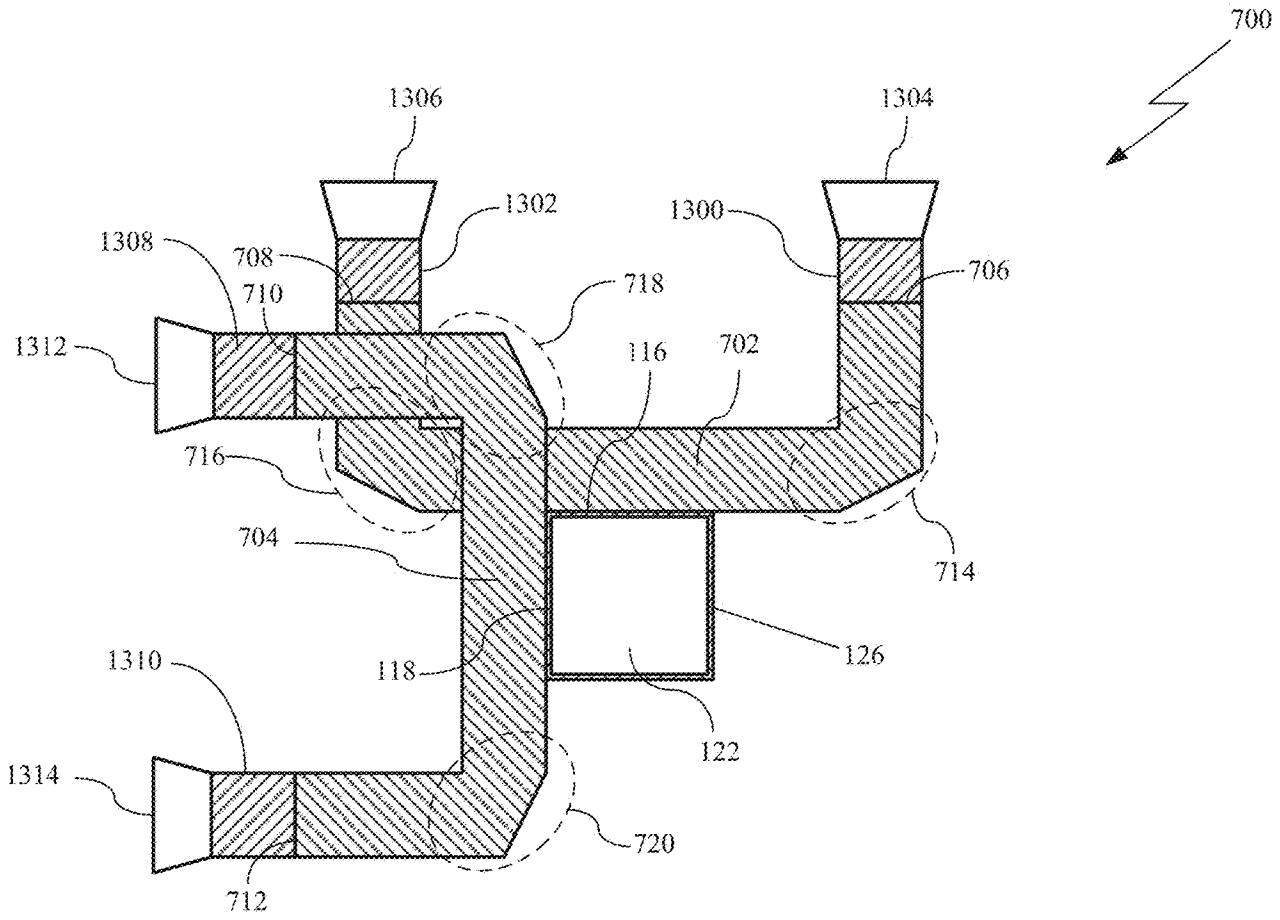
FIG. 13 is a front view of an example of the implementation of the DAAS, shown in FIG. 7, having two first-mode power amplifiers and corresponding first-mode horn antennas and two second-mode power amplifiers and corresponding second-mode horn antennas in accordance with the present disclosure.

As another example, in FIG. 13, a front view of an example of the implementation of the DAAS 700 (shown in FIG. 7) is shown having two FMPAs 1300 and 1302 and corresponding first-mode horn antennas 1304 and 1306, and two SMPAs 1308 and 1310 and corresponding second-mode horn antennas 1312 and 1314 in accordance with the present disclosure. In this example (as in the example shown in FIG. 7), the bent FMDC 702 and bent SMDC 704 are "U" shaped waveguide structures that utilize multiple bends (i.e., first bend 714 and second bend 716 for the bent FMDC 702 and first bend 718 and second bend 720 for bent SMDC 704) that are generally known as "E-bends" because they distort the electric fields within the respective waveguide structures. As such, the first bend 714 and second bend 716 for the bent FMDC 702 and first bend 718 and second bend 720 for bent SMDC 704 may be constructed utilizing a gradual bend or a number of step transitions that are designed to minimize the reflections in the waveguide. The reason for utilizing first bend 714 and second bend 716 for the bent FMDC 702 and first bend 718 and second bend 720 for bent SMDC 704 is to allow the first-mode horn antennas 1304 and 1306 to radiated in a normal (i.e., perpendicular) direction away from the surface of first ASF waveguide wall 116 and the second-mode horn antennas 1312 and 1314 to radiated in a normal direction away from the surface of second ASF waveguide wall 118 at an orthogonal angle (i.e., at 90 degrees) to the normal direction from the first ASF waveguide wall 116.

Figure 14:
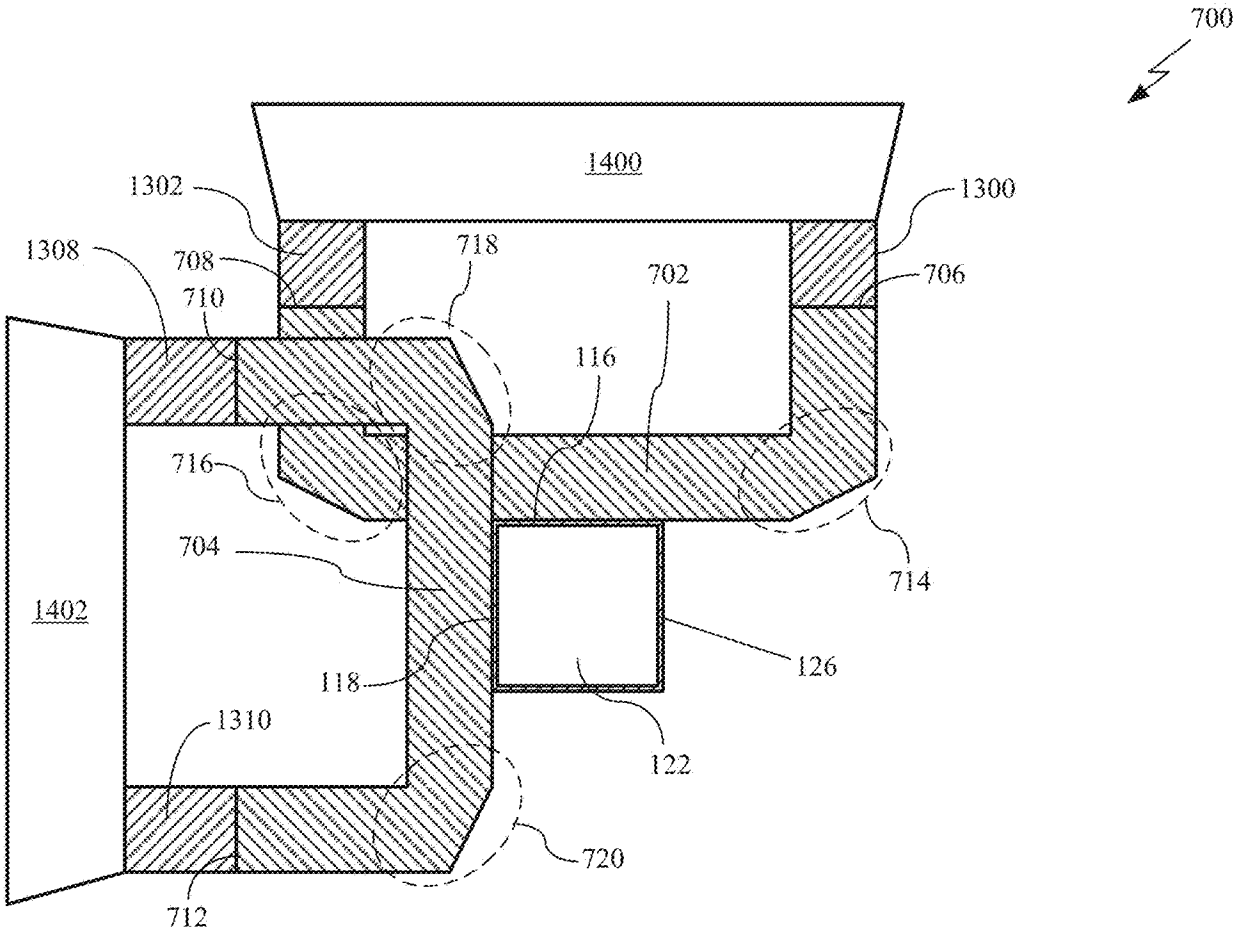
FIG. 14 is a front view of an example of the implementation of the DAAS, shown in FIG. 7, having two first-mode power amplifiers and one corresponding first-mode horn septum antenna and two second-mode power amplifiers and one corresponding second-mode horn septum antennas in accordance with the present disclosure.

FIG. 14 is a front view of an example of another implementation of the DAAS 700 (shown in FIG. 7) having the same two FMPAs 1300 and 1302 and one corresponding first-mode horn septum antenna 1400 and the two SMPAs 1308 and 1310 and one corresponding second-mode horn septum antenna 1402 in accordance with the present disclosure. This example is essentially the same as the example shown in FIG. 13; however, the two first-mode horn antennas 1304 and 1306 have been replaced with a single first-mode horn septum antenna 1400 and the two second-mode horn antennas 1312 and 1314 have been replaced with a single second-mode horn septum antenna 1402. In this example, the first-mode horn septum antenna 1400 and second-mode horn septum antenna 1402 both include a septum polarizer such that the first-mode horn septum antenna 1400 is a horn antenna having a first-mode septum polarizer (i.e., a septum polarizer that operates in a first-mode such as, for example, $TE_{10}$ mode) and the second-mode horn septum antenna 1402 is a horn antenna having a second-mode septum polarizer (i.e., a septum polarizer that operates in a second-mode such as, for example, $TE_{01}$ mode).

Figure 15:
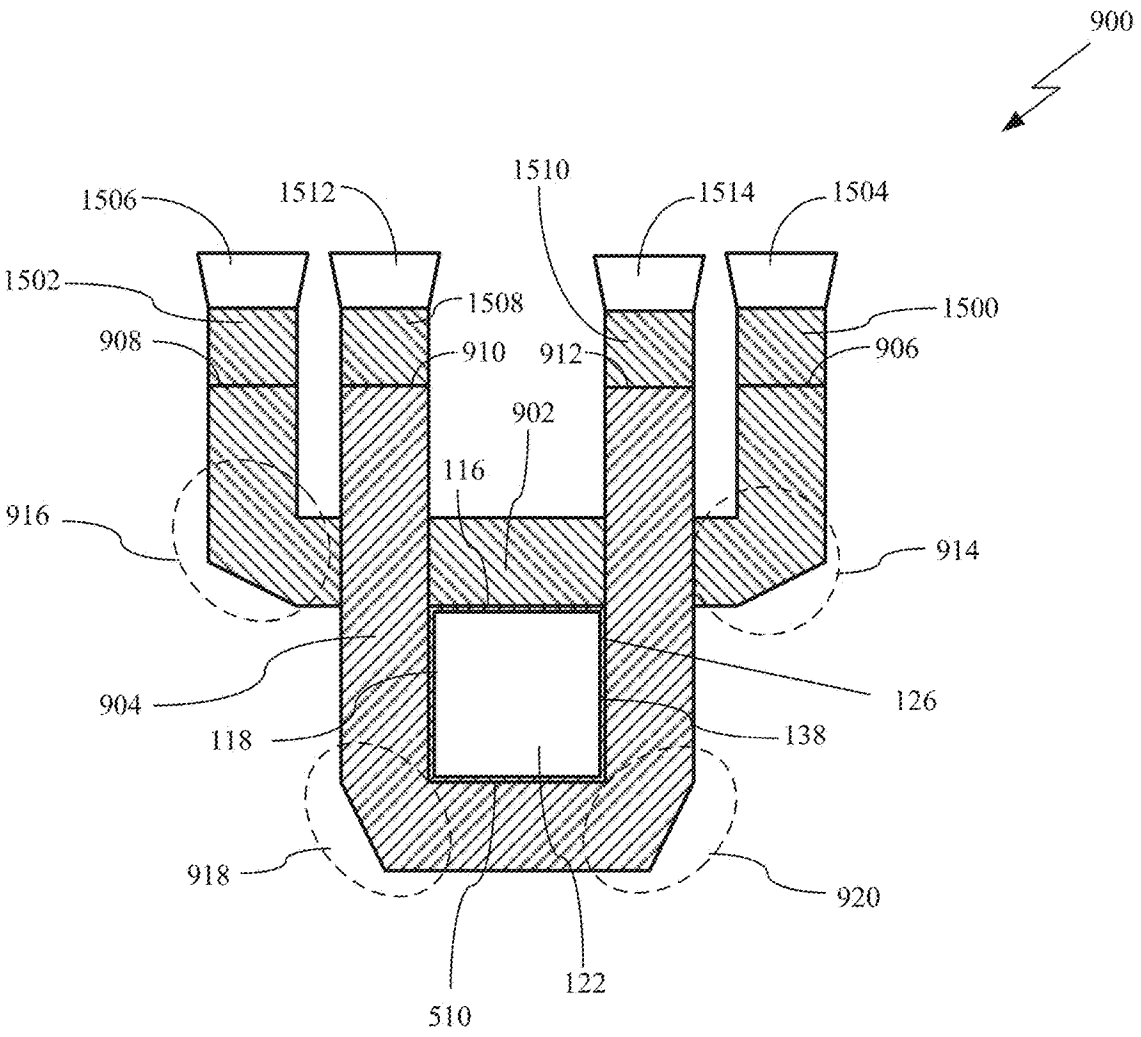
FIG. 15 is a front view of an example of the implementation of the DAAS, shown in FIG. 9, having two first-mode power amplifiers and corresponding first-mode horn antennas and two second-mode power amplifiers and corresponding second-mode horn antennas in accordance with the present disclosure.

In FIG. 15, a front view of an example of the implementation of the DAAS, 900 (shown in FIG. 9) is shown having two FMPAs 1500 and 1502 and corresponding first-mode horn antennas 1504 and 1506 and two SMPAs 1508 and 1510 and corresponding second-mode horn antennas 1512 and 1514 in accordance with the present disclosure. In this example (as in the example shown in FIG. 9), the bent FMDC 902 and bent SMDC 904 are "U" shaped waveguide structures that utilize multiple bends (i.e., first bend 914 and second bend 916 for the bent FMDC 902 and first bend 918 and second bend 920 for bent SMDC 904) that are E-bends (similar to the example of FIGS. 13 and 14). However, as stated in the example shown in FIG. 9, in this example, the reason for utilizing first bend 914 and second bend 916 for the bent FMDC 902 and first bend 918 and second bend 920 for bent SMDC 904 is to allow the first-mode horn antennas 1504 and 1506 to radiated in a normal (i.e., perpendicular) direction away from the surface of first ASF waveguide wall 116 and the second-mode horn antennas 1504 and 1506 to also radiated in a normal direction away from the ASF waveguide wall 116, instead of a normal direction from the surface of second ASF waveguide wall 118. Again, the first bend 914 and second bend 916 for the bent FMDC 902 and first bend 918 and second bend 920 for bent SMDC 904 may be constructed utilizing a gradual bend or a number of step transitions that are designed to minimize the reflections in the waveguide.

Figure 16:
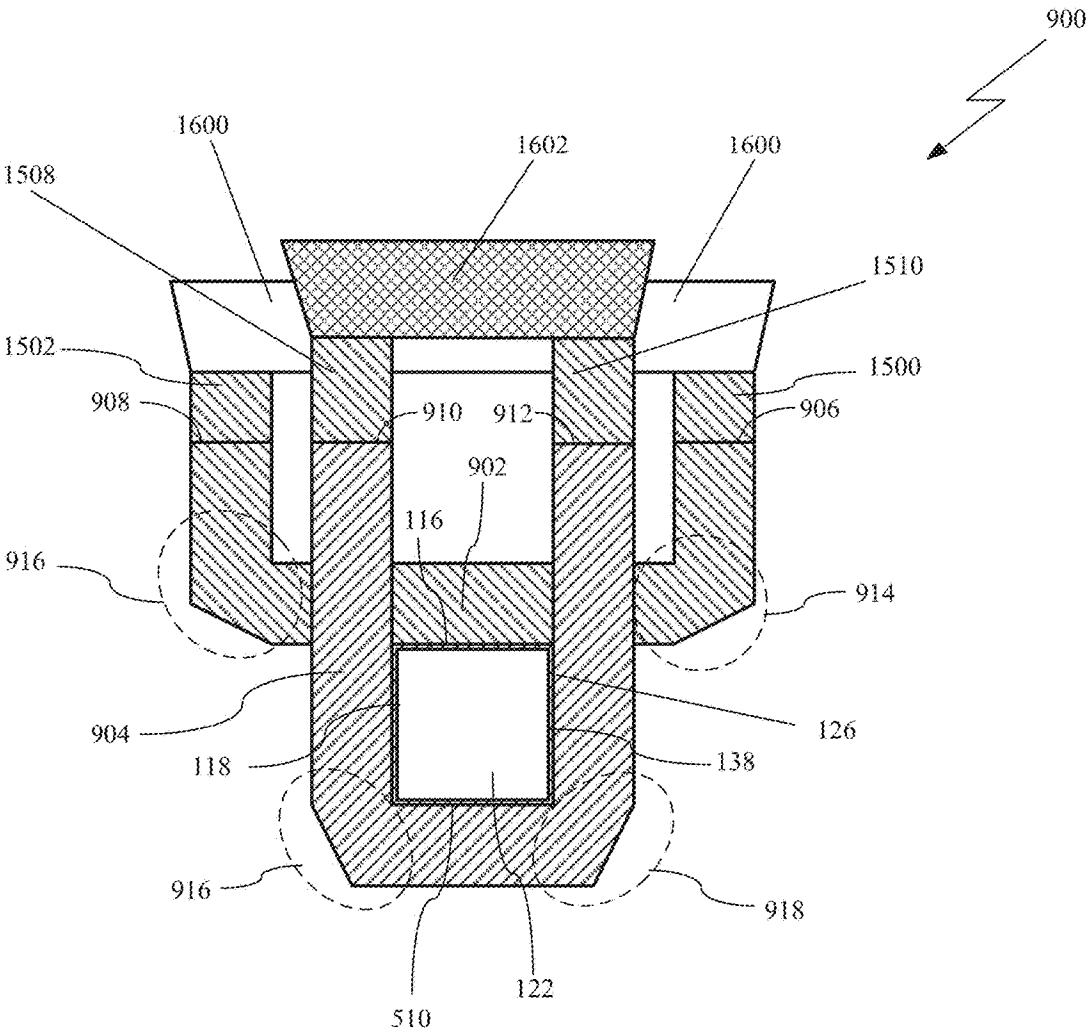
FIG. 16 is a front view of an example of the implementation of the DAAS, shown in FIG. 9, having two first-mode power amplifiers and one corresponding first-mode horn septum antenna and two second-mode power amplifiers and one corresponding second-mode horn septum antenna in accordance with the present disclosure.

FIG. 16 is a front view of an example of another implementation of the DAAS 900 (shown in FIG. 9) having same two FMPAs 1500 and 1502 and one corresponding first-mode horn septum antenna 1600 and two SMPAs 1508 and 1510 and one corresponding second-mode horn septum antenna 1602 in accordance with the present disclosure. Similar to the example in FIG. 14, this example is essentially the same as the example shown in FIG. 15; however, the two first-mode horn antennas 1504 and 1506 have been replaced with a single first-mode horn septum antenna 1600 and the two second-mode horn antennas 1512 and 1514 have been replaced with a single second-mode horn septum antenna 1602. In this example, the first-mode horn septum antenna 1600 and second-mode horn septum antenna 1602 both include a septum polarizer such that the first-mode horn septum antenna 1600 is a horn antenna having a first-mode septum polarizer (i.e., a septum polarizer that operates in a first-mode such as, for example, $TE_{10}$ mode) and the second-mode horn septum antenna 1602 is a horn antenna having a second-mode septum polarizer (i.e., a septum polarizer that operates in a second-mode such as, for example, $TE_{01}$ mode).

Figure 17A:
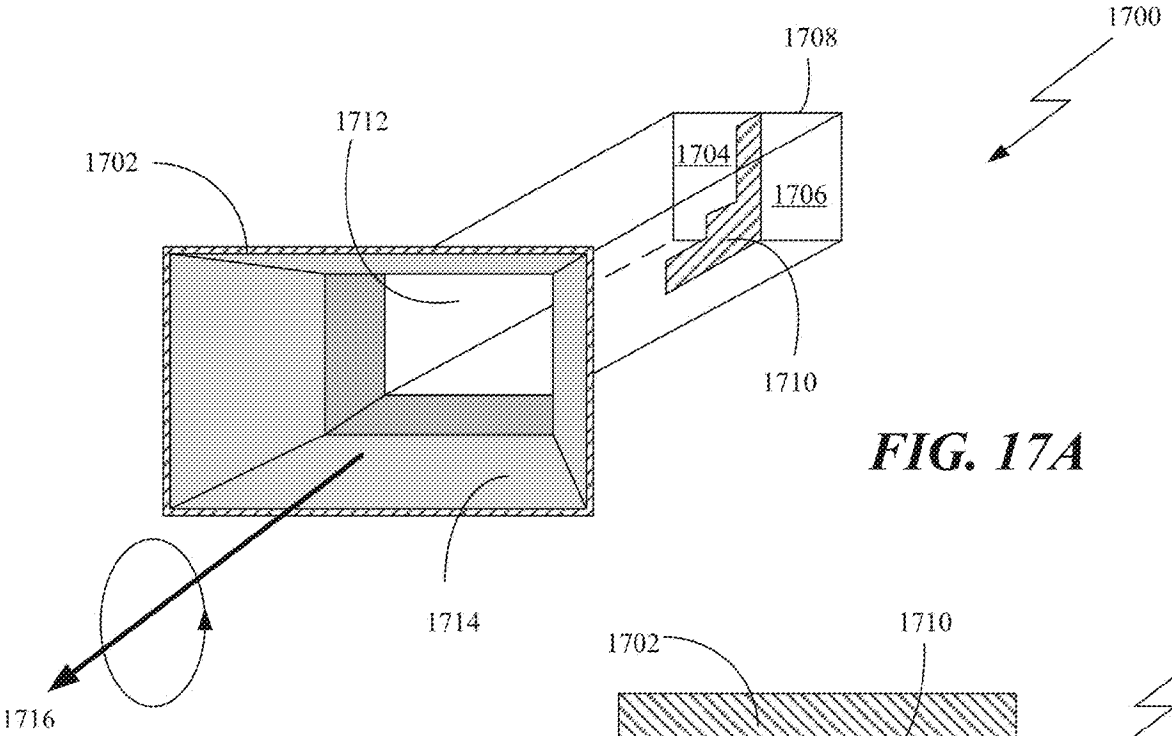
FIG. 17A is a front-perspective view of an example of an implementation of a horn septum antenna for use with the DAAS in accordance with the present disclosure.

Turning to FIG. 17A, a front-perspective view of an example of an implementation of a horn septum antenna 1700 for use with the DAAS is shown in accordance with the present disclosure. In general, the horn septum antenna 1700 is an antenna that consists of a flaring metal waveguide 1702 shaped like a horn to direct radio waves in a beam. In this example, the horn septum antenna 1700 includes a first horn input 1704 and a second horn input 1706 at the feed input 1708 of the horn septum antenna 1700. In this example, the horn septum antenna 1700 includes a septum polarizer 1710. It is appreciated by those of ordinary skill in the art that a septum polarizer 1710 is a waveguide device that is configured to transform a linearly polarized signal at the first horn input 1704 and second horn input 1706 into a circularly polarized signal at the output 1712 of the waveguide into a horn antenna aperture 1714. The horn septum antenna 1700 then radiates a circularly polarized signal 1716 into free space. In these examples, both the first-mode and second-mode horn septum antennas may be implemented as the horn septum antenna 1704.

Figure 17B:
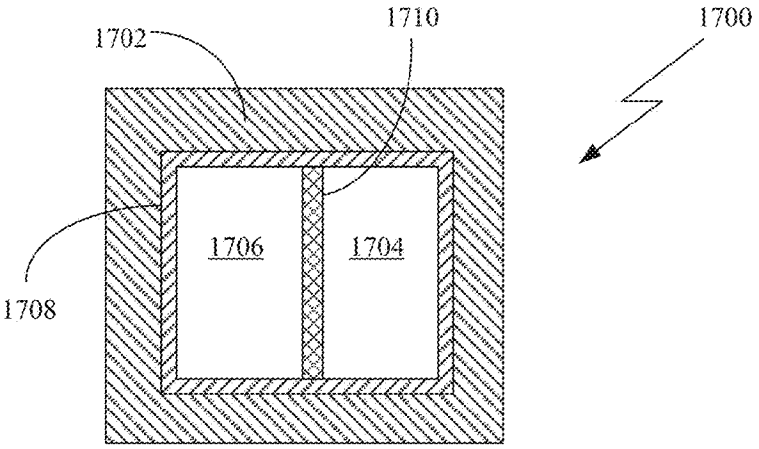
FIG. 17B is a back view of the horn septum antenna (shown in FIG. 17A) showing a first horn input, a second horn input, and a septum polarizer.

FIG. 17B is a back view of the horn septum antenna 1700 (shown in FIG. 17A) showing the first horn input 1704, second horn input 1706, and septum polarizer 1710. In this example, the horn septum antenna 1700 is shown to be a septum horn but the horn antenna 1700 may also be another type of horn antenna based on the required design parameters of the DAAS. Examples of other types of horn antennas that may be utilized as a horn antenna include, for example, a pyramidal horn, conical horn, exponential horn, and ridged horn.

In an example of operation, linear signals feed into the first horn input 1704 may be transformed into right-hand circularly polarized ("RHCP") signals at the output 1712 of the waveguide, while linear signals feed into the second horn input 1706 may be transformed into left-hand circularly polarized ("LHCP") signals at the output 1712 of the waveguide or vis-versa. The RHCP or LHCP signals may then be transmitted as the circularly polarized signal 1716 into free space.

Alternatively, a different horn antenna design may be utilized that produces linear polarization signals, instead of circularly polarized signals, from the linear signals feed into the first horn input (not shown) and the second horn input (not shown). Vertical and horizontal polarized signals, instead of RHCP and LHCP signals, may then be transmitted into free space. In this example an OMT may be utilized at each element rather than a septum polarizer. An alternative to utilizing a horn septum antenna 1700 with the septum 1710 is to adjust the relative phase between the first-mode input signal 130 (at the first-feed waveguide input 122) and first-mode input signal 134 (at the second-feed waveguide input 124) in such a way that each FMDC output runs to a single first-mode horn antenna (not a septum polarizer fed horn). Similarly, the relative phase between the second-mode input signal 132 (at the first-feed waveguide input 122) and second-mode input signal 136 (at the second-feed waveguide input 124) may also be adjusted in such a ways that each SMDC output also runs to a single second-mode horn antenna.

In this example, there would be two arrays of first-mode horn antennas instead of one array of first-mode horn septum antennas and two additional arrays of second-mode horn antennas instead of one array of second-mode horn septum antennas. In this example, a first array of first-mode horn antennas excited by the first-mode input signal 130, at the first-feed waveguide input 122, may run parallel to a second array of first-mode horn antennas excited by the first-mode input signal 134 at the second-feed waveguide input 124. Similarly, a first array of second-mode horn antennas excited by the second-mode input signal 132, at the first-feed waveguide input 122, may run parallel to a second array of first-mode horn antennas excited by the second-mode input signal 136 at the second-feed waveguide input 124.

Figure 18:
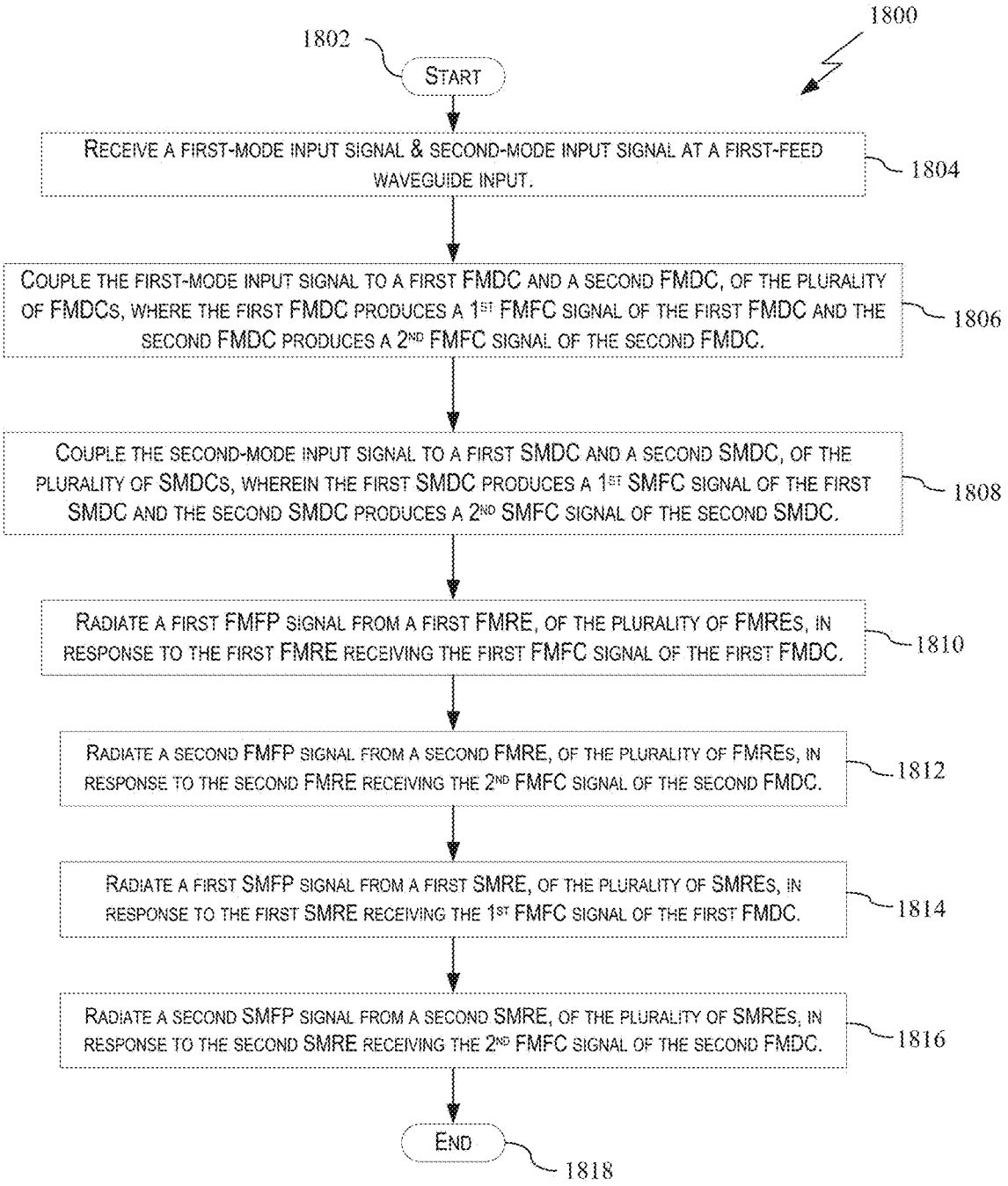
FIG. 18 is flowchart describing an example of an implementation of a method performed by the DAAS shown in FIGS. 1A-16 in accordance with the present disclosure.

FIG. 18 is flowchart describing an example of an implementation of a method 1800 performed by the DAAS shown in FIGS. 1A-16 in accordance with the present disclosure. The method 1800 that starts 1802 by first receiving 1804 the first-mode input signal 130 and a second-mode input signal 132 at the first-feed waveguide input 122. The method 1800 further includes coupling 1806 the first-mode input signal 130 to a first FMDC 104*a* and a second FMDC 104*b*, of the plurality of FMDCs 104*a*, 104*b*, 104*c*, 104*d*, 104*e*, 104*f*, 104*g*, 104*h*, where the first FMDC 104*a* produces a first first-mode forward coupled ("1$^{st}$ FMFC") signal 300 of the first FMDC 104*a* and the second FMDC 104*b* produces a second first-mode forward coupled ("2$^{nd}$ FMFC") signal 304 of the second FMDC 104*b* and coupling 1808 the second-mode input signal 132 to a first SMDC 106*a* and a second SMDC 106*b*, of the plurality of SMDCs 106*a*, 106*b*, 106*c*, 106*d*, 106*e*, 106*f*, 106*g*, 106*h*, wherein the first SMDC 106*a* produces a first second-mode forward coupled ("1$^{st}$ SMFC") signal 360 of the first SMDC 106*a* and the second SMDC 106*b* produces a second second-mode forward coupled ("2$^{nd}$ SMFC") signal 362 of the second SMDC 106*b*.

The method 1800 then includes radiating 1810 a first first-mode forward polarized ("FMFP") signal from a first FMRE, of the plurality of FMREs, in response to the first FMRE receiving the first FMFC signal 300 of the first FMDC 104*a*, radiating 1812 a second FMFP signal from a second FMRE, of the plurality of FMREs, in response to the second FMRE receiving the 2$^{nd}$ FMFC signal 304 of the second FMDC 104*b*, radiating 1814 a first second-mode forward polarized ("SMFP") signal from a first SMRE, of the plurality of SMREs, in response to the first SMRE receiving the 1$^{st}$ FMFC signal 300 of the first FMDC 104*a*, and radiating 1816 a second SMFP signal from a second SMRE, of the plurality of SMREs, in response to the second SMRE receiving the 2$^{nd}$ FMFC signal 304 of the second FMDC 104*b*. The method then ends 1818. In this example, the first FMFP signal is co-polarized with the second FMFP signal and the first SMFP signal is co-polarized with the second SMFP signal.

The method (1800) may also include receiving a first-mode input signal 134 and a second-mode input signal 136 at the second-feed waveguide input 124, wherein the first-mode input signal 134 and a second-mode input signal 136 are propagating in an opposite direction than the first-mode input signal 130 and the second-mode input signal 132. Then method (1800) then couples the first-mode input signal 134 to the second FMDC 104*b* and the first FMDC 104*a*, wherein the second FMDC 104*b* produces a first first-mode reverse coupled ("1$^{st}$ FMRC") signal 354 of the second FMDC 104*b* and the first FMDC 104*a* produces a second first-mode reverse coupled ("2$^{nd}$ FMRC") signal 358 of the first FMDC 104*a*; and couples the second-mode input signal 132 to the second SMDC 106*b* and the first SMDC 106*a*, wherein the second SMDC 106*b* produces a first second-mode reverse coupled ("1$^{st}$ SMRC") signal 387 of the second SMDC 106*b* and the first SMDC 106*a* produces a second second-mode reverse coupled ("2$^{nd}$ SMRC") signal 389 of the first SMDC 106*a*. The method (1800) then radiates a first first-mode reverse polarized ("FMRP") signal from a third FMRE, of the plurality of FMREs, in response to the third FMRE receiving the first FMRC signal 354 of the second FMDC 104*b*; radiates a second FMRP signal from a fourth FMRE, of the plurality of FMREs, in response to the fourth FMRE receiving the 2$^{nd}$ FMRC signal 358 of the first FMDC 104*a*; radiating a first second-mode reverse polarized ("SMRP") signal from a third FMRE, of the plurality of FMREs, in response to the third FMRE receiving the 1$^{st}$ SMRC signal 387 of the second SMDC 106*b*; and radiating a second SMRP signal from a fourth FMRE, of the plurality of FMREs, in response to the fourth FMRE receiving the 2$^{nd}$ SMRC signal 389 of the first SMDC 106*a*. The method (1800) may further include amplifying the first FMFC signal 300 and the 2$^{nd}$ FMFC signal 304, amplifying the first SMFC signal 360 and the second SMFC signal 362, amplifying the first FMRC signal 354 and the 2$^{nd}$ FMFC signal 358, and amplifying the first SMRC signal 387 and the second SMFC signal 389. In this example, the first FMRP signal is co-polarized with the second FMRP signal and the first SMRP signal is co-polarized with the second SMRP signal, the first FMRP signal and second FMRP signal are cross-polarized with the first FMFP signal and the second FMFP signal, and the first SMRP signal and second SMRP signal are cross-polarized with the first SMFP signal and the second SMFP signal.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A dual-mode antenna array system for directing and steering an antenna beam comprising:

a waveguide having a substantially square cross-section, the waveguide configured to propagate electromagnetic energy in first and second modes;

a first end of the waveguide configured to receive a first input signal of a first mode of propagation and configured to receive a second input signal of a second mode of propagation, wherein the waveguide is configured to propagate the first and second input signals in a first direction;

a second end of the waveguide configured to receive a third input signal of the first mode of propagation and configured to receive a fourth input signal of the second mode of propagation, wherein the waveguide is configured to propagate the third and fourth input signals in a second direction opposite of the first direction;

a first coupler disposed on a first wall of the waveguide between the first and second ends of the waveguide, the first coupler arranged substantially perpendicular to the waveguide, wherein the first coupler is configured to couple a portion of the first and third input signals into the first coupler; and a second coupler disposed on a second wall of the waveguide between the first and second ends of the waveguide, the second coupler arranged substantially perpendicular to the first coupler and to the waveguide, wherein the second coupler is configured to couple a portion of the second and fourth input signals into the second coupler, and wherein each of the first and second couplers includes at least one open end configured to radiate a signal.

2. The dual-mode antenna array system of claim 1, wherein the first wall of the waveguide includes a first pair of apertures and the second wall of the waveguide includes a second pair of apertures.

3. The dual-mode antenna array system of claim 1, further comprising:

a first radiating element coupled to a first end of the first coupler; and a second radiating element coupled to a first end of the second coupler.

4. The dual-mode antenna array system of claim 1, wherein the signal comprises at least one polarized signal.

5. The dual-mode antenna array system of claim 1, wherein the first coupler includes at least two bends, and wherein the second coupler includes at least two bends.

6. The dual-mode antenna array system of claim 1, wherein the waveguide is a meandering waveguide.

7. The dual-mode antenna array system of claim 1, further including:

a first amplifier coupled between the first coupler and a first radiating element; and a second amplifier coupled between the second coupler and a second radiating element.

8. The dual-mode antenna array system of claim 1, wherein the first coupler is configured to generate a first forward coupled signal based on the portion of the first input signal and configured to generate a first reverse coupled signal based on the portion of the third input signal, and wherein the second coupler is configured to generate a second forward coupled signal based on the portion of the third input signal and configured to generate a second reverse coupled signal based on a portion of the fourth input signal.

9. The dual-mode antenna array system of claim 1, further comprising:

a first orthomode transducer coupled to the first end of the waveguide and configured to generate the first input signal and the second input signal, the first and second input signals being orthogonally polarized; and a second orthomode transducer coupled to the second end of the waveguide and configured to generate the third input signal and the fourth input signal, the third and fourth input signals being orthogonally polarized.

10. The dual-mode antenna array system of claim 1, wherein the first mode comprises a $TE_{10}$ mode and the second mode comprises a $TE_{01}$ mode.

11. The dual-mode antenna array system of claim 2, wherein the first pair of apertures comprises a first aperture and a second aperture, wherein the first and second apertures are positioned approximately a quarter-wavelength apart of an operating frequency of the first mode, wherein the second pair of apertures comprises a first aperture and a second aperture, wherein the first and second apertures of the second pair of apertures are positioned approximately a quarter-wavelength apart of an operating frequency of the second mode.

12. The dual-mode antenna array system of claim 11, wherein each of the first and second apertures of the first pair of apertures comprise a slot, a crossed-slot, or a circular orifice, and wherein each of the first and second apertures of the second pair of apertures comprise a slot, a crossed-slot, or a circular orifice.

13. The dual-mode antenna array system of claim 3, wherein the first radiating element is configured to produce a first polarized signal, and wherein the second radiating element is configured to produce a second polarized signal.

14. The dual-mode antenna array system of claim 3, wherein each of the first and second radiating elements comprises a horn antenna.

15. The dual-mode antenna array system of claim 3, wherein the first radiating element comprises a septum polarizer, and wherein the second radiating element comprises septum polarizer.

16. The dual-mode antenna array system of claim 13, further comprising:

a third radiating element coupled to a second end of the first coupler; and a fourth radiating element coupled to a second end of the second coupler.

17. The dual-mode antenna array system of claim 16, wherein the third radiating element is configured to produce a third polarized signal, and wherein the fourth radiating element is configured to produce a fourth polarized signal.

18. The dual-mode antenna array system of claim 16, wherein each of the third and fourth radiating elements comprises a horn antenna.

19. The dual-mode antenna array system of claim 14, wherein each of the horn antennas include a septum polarizer.

20. The dual-mode antenna array system of claim 17, wherein the third polarized signal is co-polarized with the first polarized signal and the fourth polarized signal is co-polarized with the second polarized signal.

21. The dual-mode antenna array system of claim 18, wherein each horn antenna includes a septum polarizer.

22. The dual-mode antenna array system of claim 1, wherein each end of the first coupler is configured to radiate a signal and wherein each end of the second coupler is configured to radiate a signal.

23. A method for directing and steering an antenna beam utilizing an dual-mode antenna array system including a waveguide having a substantially square cross-section and configured to propagate electromagnetic energy in first and second modes, the method comprising:

receiving a first input signal of a first mode of propagation and a second input signal of a second mode of propagation at a first end of the waveguide, wherein the first and second input signals are propagated in a first direction;

receiving a third input signal of the first mode of propagation and a fourth input signal of the second mode of propagation at a second end of the waveguide, wherein the third and fourth input signals are propagated in a second direction opposite of the first direction;

coupling the first and third input signals of the first mode of propagation into a first coupler;

coupling the second and fourth input signals of the second mode of propagation into a second coupler;

radiating a first signal from a first end of the first coupler; and radiating a second signal from a first end of the second coupler.

24. The method of claim 23, further comprising:

producing a first forward coupled signal and a first reverse coupled signal in the first coupler in response to the first and third input signals;

producing a second forward coupled signal and a second reverse coupled signal in the second coupler in response to the second and fourth input signals;

radiating a third signal from a second end of the first coupler; and radiating a fourth signal from a second end of the second coupler.

25. The method of claim 24, further including amplifying at least one of the first forward coupled signal, the second forward coupled signal, the first reverse coupled signal, or the second reverse coupled signal.

* * * * *